US006453477B1

(12) United States Patent
Bainbridge et al.

(10) Patent No.: US 6,453,477 B1
(45) Date of Patent: Sep. 24, 2002

(54) PROTECTIVE PADDING FOR SPORTS GEAR

(75) Inventors: David W. Bainbridge, Golden; L. Paul Nickerson, Superior; Grant C. Denton, Boulder, all of CO (US)

(73) Assignee: Brock USA, LLC, Boulder, CO (US)

( * ) Notice: Subject to any disclaimer, the term of this patent is extended or adjusted under 35 U.S.C. 154(b) by 0 days.

(21) Appl. No.: 10/091,323

(22) Filed: Mar. 4, 2002

Related U.S. Application Data

(63) Continuation of application No. 09/506,507, filed on Feb. 17, 2000, now Pat. No. 6,357,054, which is a continuation-in-part of application No. 09/226,311, filed on Jan. 7, 1999, now Pat. No. 6,032,300, which is a continuation-in-part of application No. 09/158,088, filed on Sep. 22, 1998, now Pat. No. 5,920,915.

(51) Int. Cl.[7] ..... A41D 13/00
(52) U.S. Cl. ..... 2/455; 2/267; 428/76
(58) Field of Search ..... 2/456, 455, 69, 2/16, 463, 464, 465, 467, 462, 410–411, 414, 68, 20, 22, 2.5, 102, 70, 92, 161.1, 909, 910, 911, 227, 267, 268, DIG. 1, DIG. 3; 5/655.4, 953, 911, 702; 128/878, 881, 882; 602/23, 25, 27, 62, 63, 65; 428/76, 313.5

(56) References Cited

U.S. PATENT DOCUMENTS

| | | | |
|---|---|---|---|
| 1,652,776 | A | 12/1927 | Galanis |
| 2,179,631 | A | 11/1939 | Holder |
| 2,298,218 | A | 10/1942 | Madson |
| 2,404,758 | A | 7/1946 | Teague et al. |
| 3,006,780 | A | 10/1961 | Shaffer |
| 3,304,219 | A | 2/1967 | Nickerson |
| 3,354,578 | A | 11/1967 | Ryan |
| 3,459,179 | A | 8/1969 | Olesen |
| 3,477,562 | A | 11/1969 | Allen et al. |

(List continued on next page.)

FOREIGN PATENT DOCUMENTS

| | | |
|---|---|---|
| CH | 577 328 | 7/1976 |
| FR | 2495-453 | 6/1982 |
| FR | 2616-655 | 12/1988 |
| GB | 1 378 494 | 12/1974 |

OTHER PUBLICATIONS

Sales Literature of Faytex Corp., circa 1998.
Sales Literature of JSP International 1998.
24 Page Brochure of Porex Technologies 1989–1992.
Sales Literature of JSP International with Product Samples 1998 and larger sample of one of the materials.

*Primary Examiner*—Gloria M. Hale
*Assistant Examiner*—Tejash Patel
(74) *Attorney, Agent, or Firm*—W. Scott Carson

(57) ABSTRACT

A porous, breathable pad for use as protective padding by a person to absorb the force of an impact and to protect the user from injury while allowing liquids and air to freely pass through the pad. The pad includes a plurality of discrete, solid beads of inelastic and waterproof, closed-cell foam wherein some outer portions of adjacent beads abut one another and other outer portions of the adjacent beads are spaced from each other to create interstitial spaces. In the preferred embodiments, substantially all of the adjacent beads are fused together at their abutting, outer portions and the interstitial spaces are substantially uniformly distributed throughout the pad.

4 Claims, 17 Drawing Sheets

U.S. PATENT DOCUMENTS 3,489,154 A 1/1970 Kaspar et al.
3,503,841 A 3/1970 Sterrett
3,529,306 A 9/1970 Thorne
3,552,044 A 1/1971 Wiele
3,563,837 A 2/1971 Smith et al.
3,606,726 A 9/1971 Spertus et al.
3,608,961 A 9/1971 Heck
3,616,162 A 10/1971 Noziere
3,629,882 A 12/1971 Thorne
3,640,787 A 2/1972 Heller
3,663,344 A 5/1972 Brock et al.
3,663,469 A 5/1972 Weissmahr
3,676,288 A 7/1972 Hoyle
3,755,063 A 8/1973 Massev et al.
3,762,404 A 10/1973 Sakita
3,816,234 A 6/1974 Winfield
3,857,731 A 12/1974 Merrill, Jr. et al.
3,864,181 A 2/1975 Wolinski et al.
3,889,444 A 6/1975 Davis et al.
3,968,530 A 7/1976 Dyson
3,968,620 A 7/1976 Keltner
3,978,263 A 8/1976 Wellensiek
4,011,611 A 3/1977 Lederman
4,054,204 A 10/1977 Keeton
4,102,109 A 7/1978 Modra et al.
4,121,399 A 10/1978 Verville
4,139,920 A 2/1979 Evans
4,171,549 A 10/1979 Morrell et al.
4,193,499 A 3/1980 Lookholder
4,229,398 A 10/1980 Harvey
4,239,519 A 12/1980 Beall et al.
4,240,998 A 12/1980 Lichter et al.
4,243,617 A 1/1981 Burge
4,343,047 A 8/1982 Lazowski et al.
4,370,754 A 2/1983 Donzis
4,391,561 A 7/1983 Smith et al.
4,432,110 A 2/1984 Sutton
4,441,905 A 4/1984 Malmendier et al.
4,443,286 A 4/1984 Ikeda et al.
4,472,472 A 9/1984 Schultz
4,475,248 A 10/1984 L'Abbe et al.
4,492,877 A 1/1985 Burnett
4,577,358 A 3/1986 Glass
4,606,087 A 8/1986 Alivizatos
4,607,403 A 8/1986 Alivizatos
4,620,633 A 11/1986 Lookholder
4,624,893 A 11/1986 Shibano et al.
4,640,080 A 2/1987 Wright
4,642,814 A 2/1987 Godfrev
4,657,003 A 4/1987 Wirtz
4,705,715 A 11/1987 DeCoste, Jr. et al.
4,740,416 A 4/1988 DeCoste, Jr. et al.
4,751,202 A 6/1988 Toussaint
4,751,203 A 6/1988 Toussaint
4,756,026 A 7/1988 Pierce
4,855,170 A 8/1989 Darvell et al.
4,905,320 A 3/1990 Squvers, Jr.
4,989,794 A 2/1991 Askew et al.
5,052,874 A 10/1991 Johanson
5,055,340 A 10/1991 Matsumura et al.
5,073,444 A 12/1991 Shanelee
5,079,787 A 1/1992 Pollmann
5,080,737 A 1/1992 Shoner
5,103,517 A 4/1992 Krouskoo
5,134,725 A 8/1992 Yeshurun et al.
5,134,726 A 8/1992 Ross
5,152,019 A 10/1992 Hirata
5,201,780 A 4/1993 Dinsmoor, III et al.
5,279,237 A 1/1994 Alivizatos
5,292,840 A 3/1994 Heilmann et al.
5,301,370 A 4/1994 Henson
5,351,830 A 10/1994 Bender et al.
5,369,829 A 12/1994 Jay
5,397,620 A 3/1995 Hord, III
5,464,443 A 11/1995 Wilson et al.
5,515,975 A 5/1996 Jarvis et al.
5,537,688 A 7/1996 Reynolds et al.
5,545,128 A 8/1996 Hayes et al.
5,584,072 A 12/1996 Kim et al.
5,587,231 A 12/1996 Mereer et al.
5,614,310 A 3/1997 Delgado et al.
5,622,030 A 4/1997 Steed et al.
5,626,657 A 5/1997 Pearce
5,669,079 A 9/1997 Morgan
5,675,844 A 10/1997 Guvton et al.
5,694,747 A 12/1997 Tesch
5,699,561 A 12/1997 Broersma
5,711,029 A 1/1998 Visco et al.
5,711,215 A 1/1998 Sextl et al.
5,712,015 A 1/1998 Guillem
5,720,714 A 2/1998 Penrose
5,733,012 A 3/1998 Jones
5,746,013 A 5/1998 Fay, Sr.
5,778,470 A 7/1998 Haider
5,826,273 A 10/1998 Eckes
5,888,642 A 3/1999 Meteer et al.
5,916,672 A 6/1999 Reeves
5,920,915 A * 7/1999 Bainbridge et al. ..... 2/16
6,027,806 A 2/2000 Abe et al.
6,032,300 A * 3/2000 Bainbridge et al. ..... 2/16
6,055,676 A 5/2000 Bainbridge et al.
6,357,054 B1 * 3/2002 Bainbridge et al. ..... 2/267

* cited by examiner

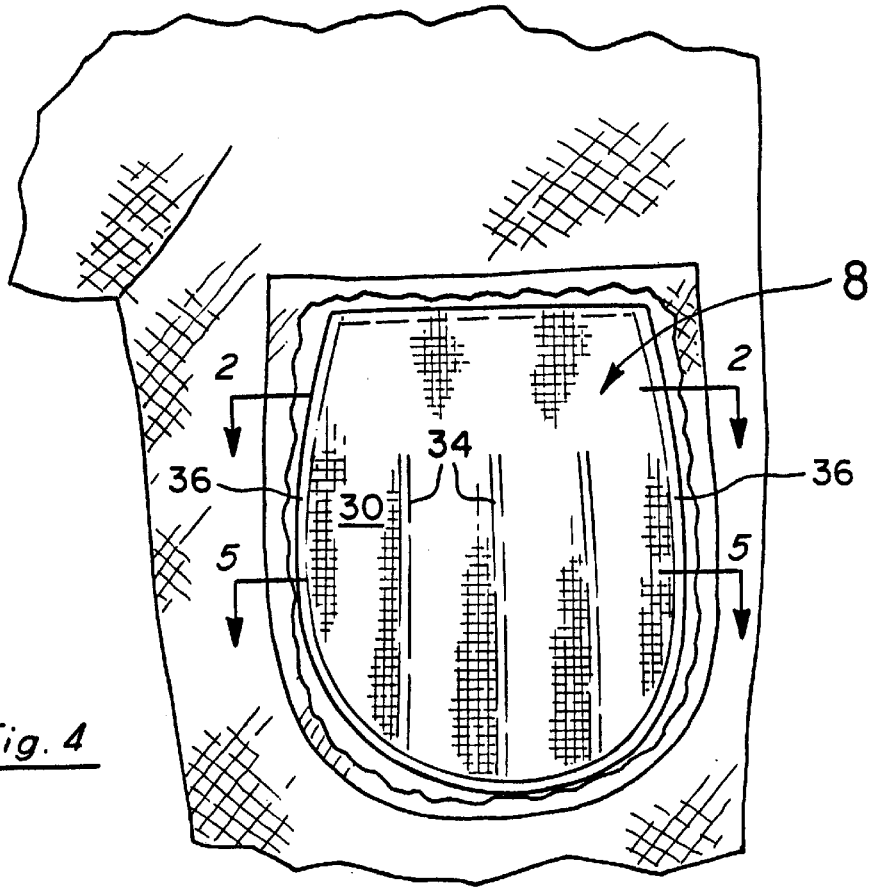
Fig. 4
Fig. 5
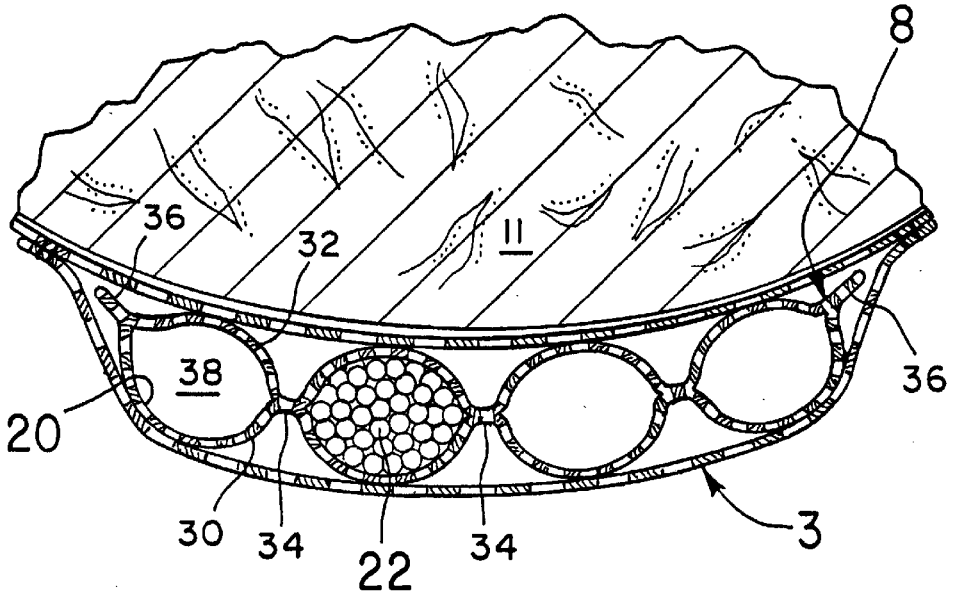

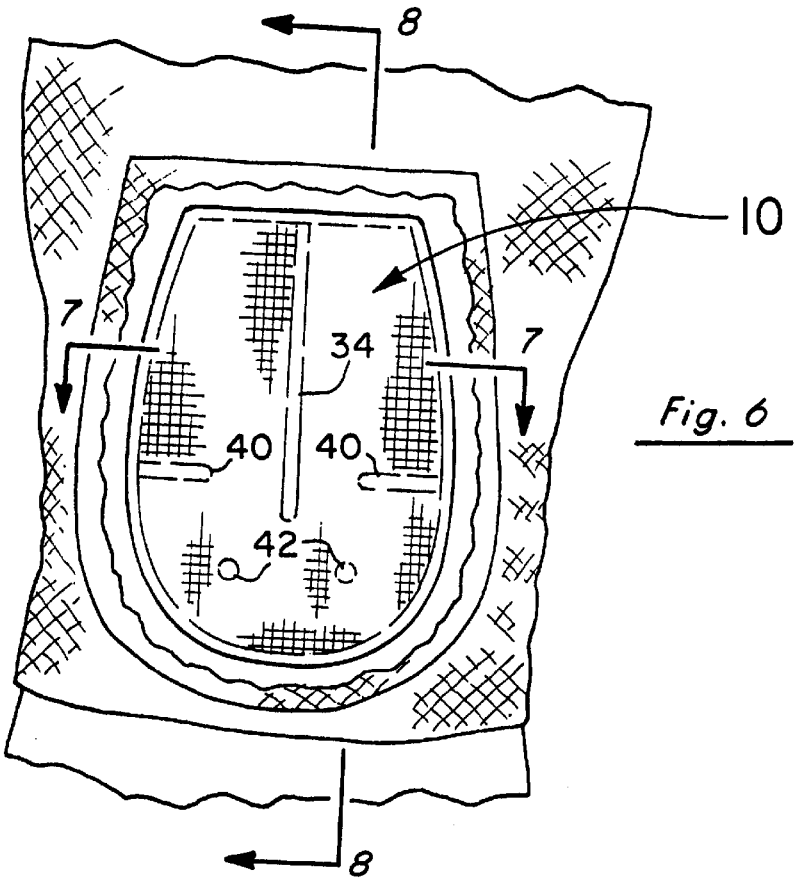
Fig. 6
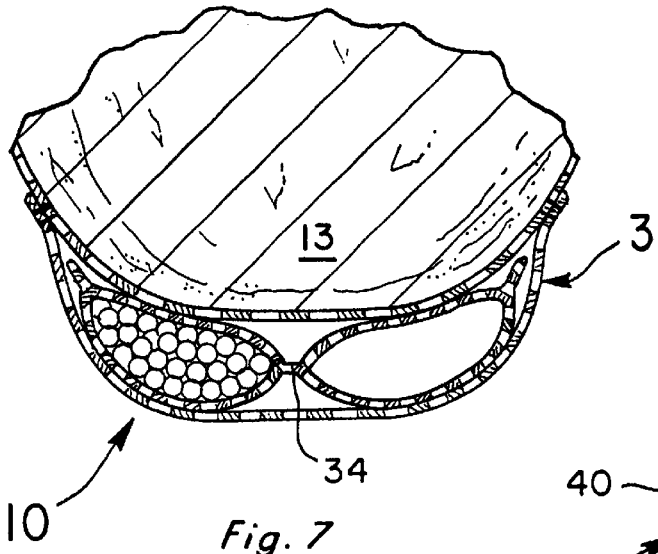
Fig. 7
Fig. 8
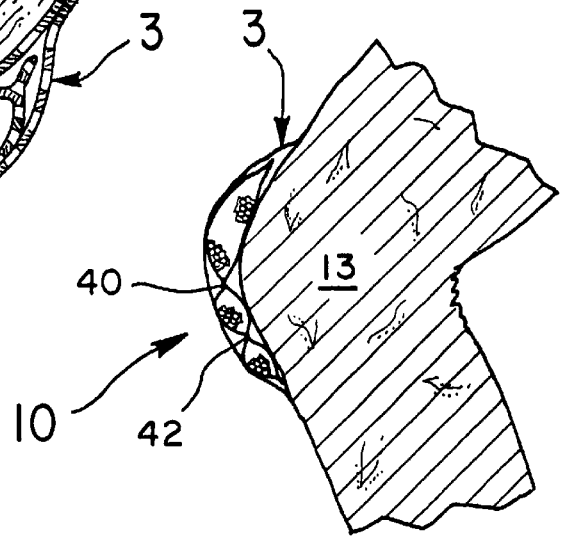

Fig. 10
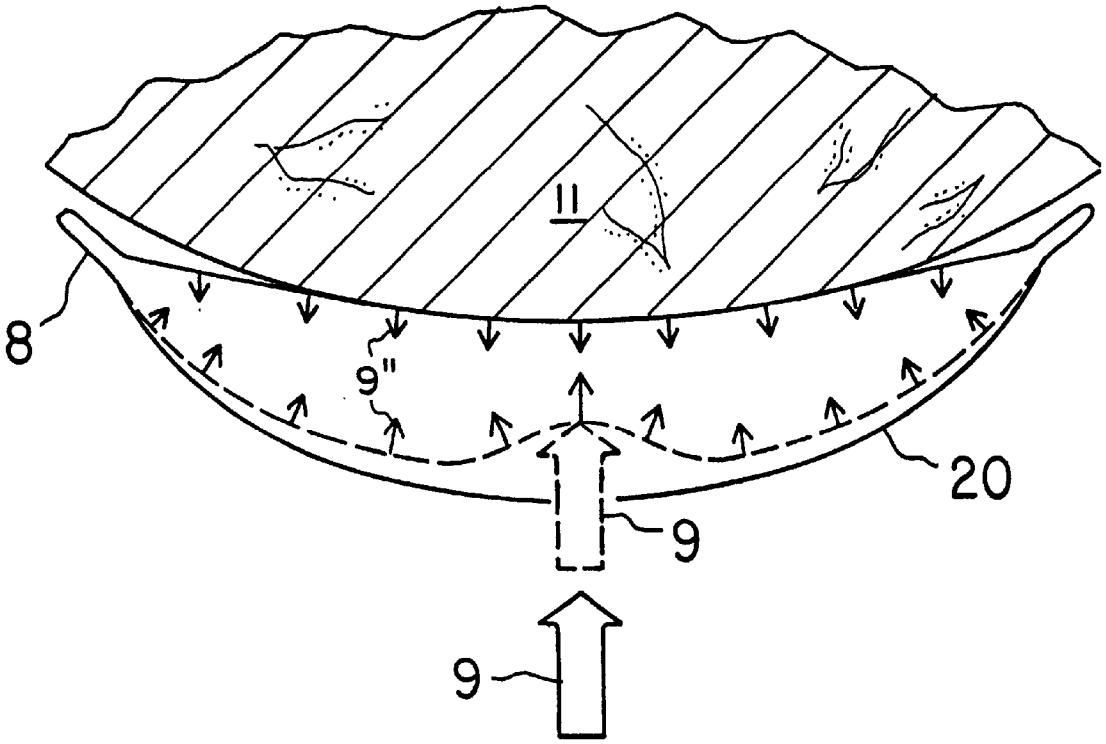
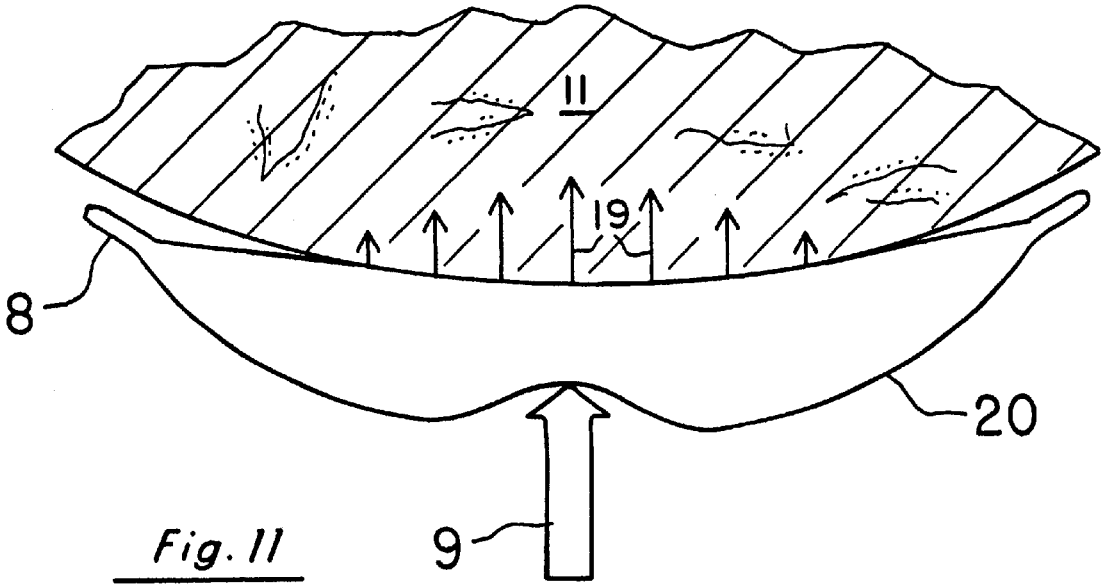
Fig. 11

Fig. 12
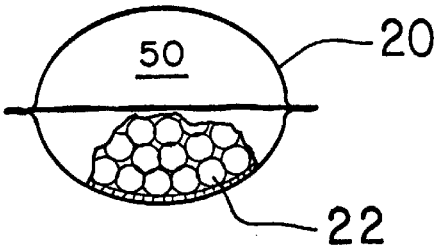
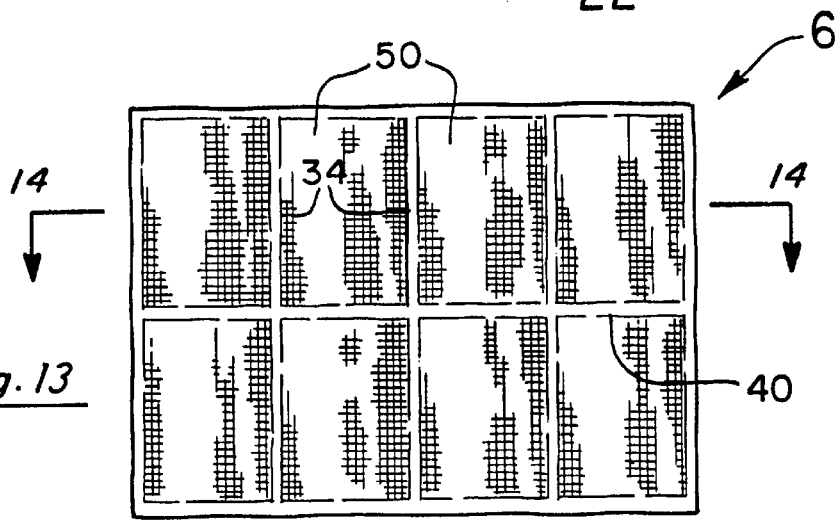
Fig. 13
Fig. 14
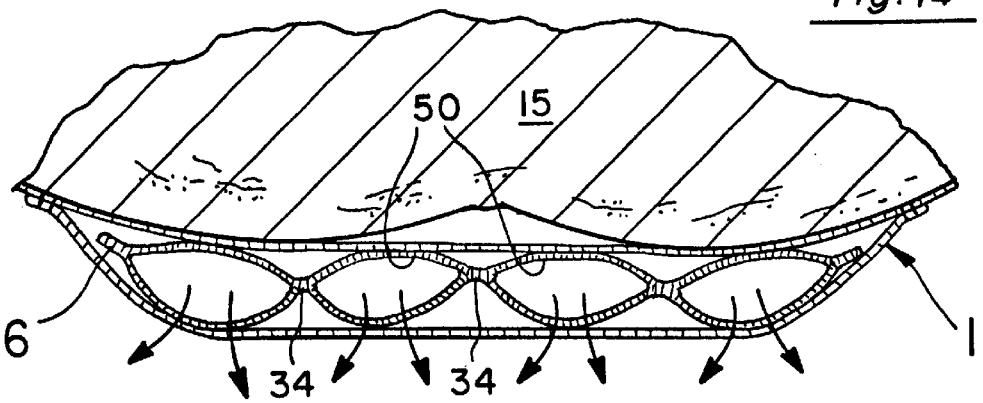
Fig. 15
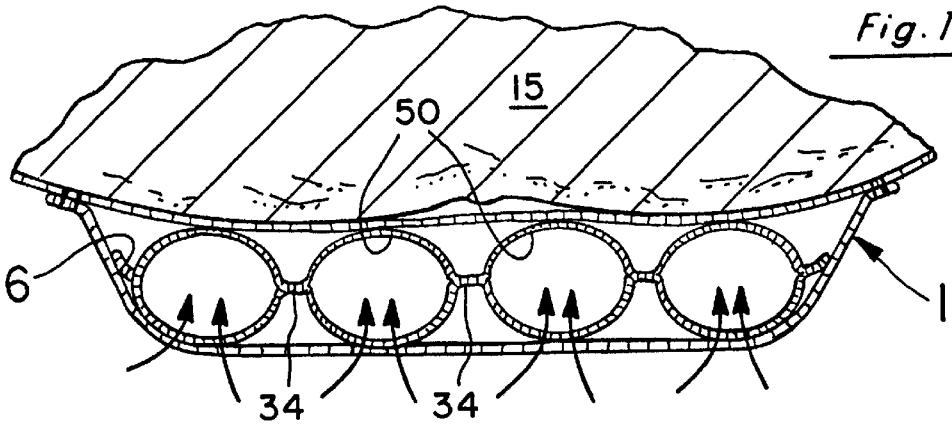

Fig. 16
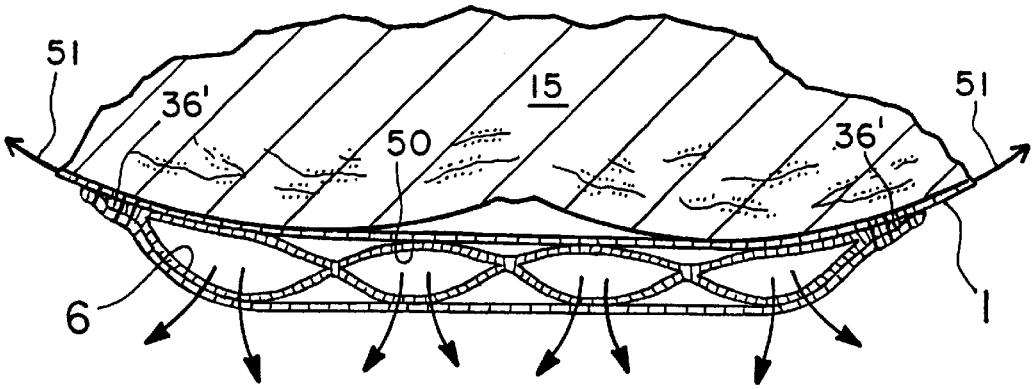
Fig. 17
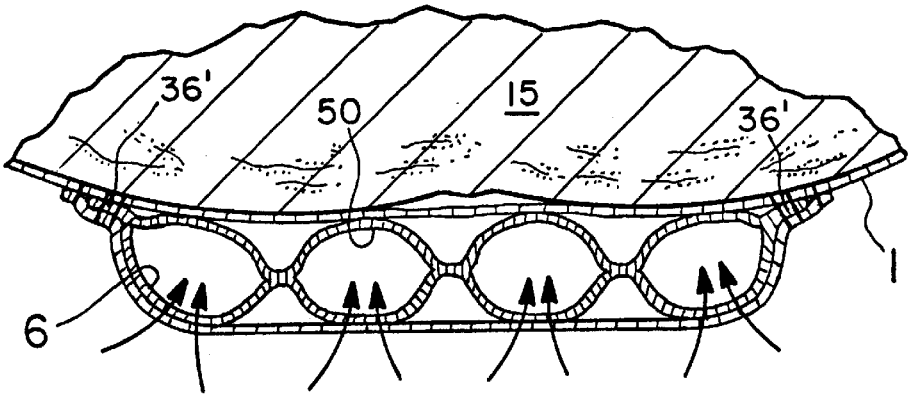
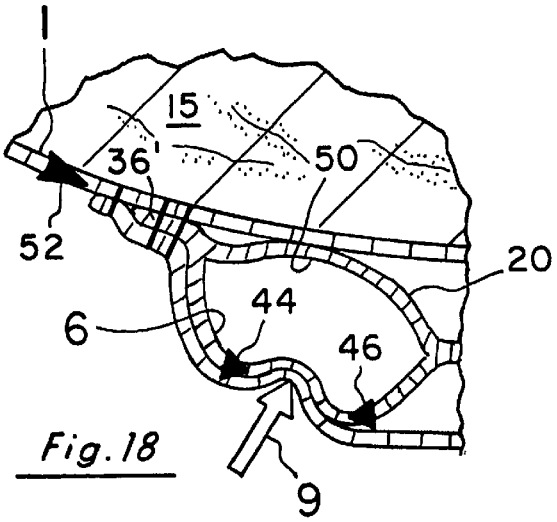
Fig. 18
Fig. 19
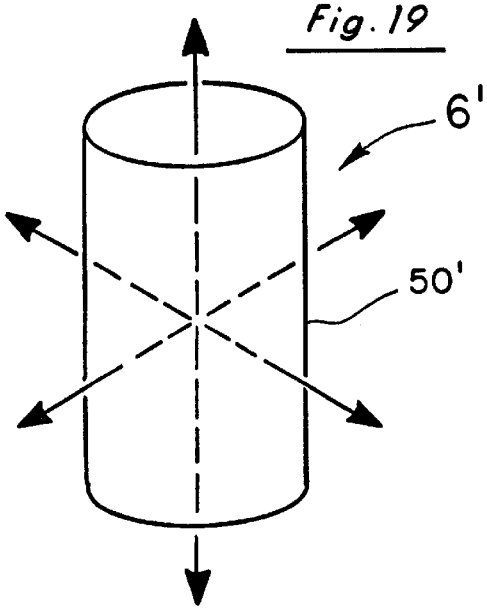

Fig. 20
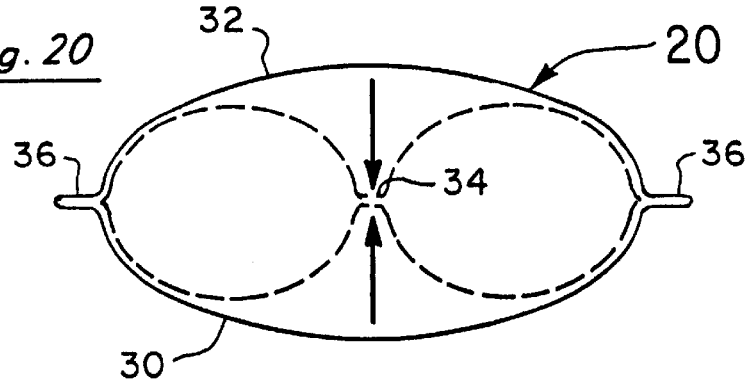
Fig. 21
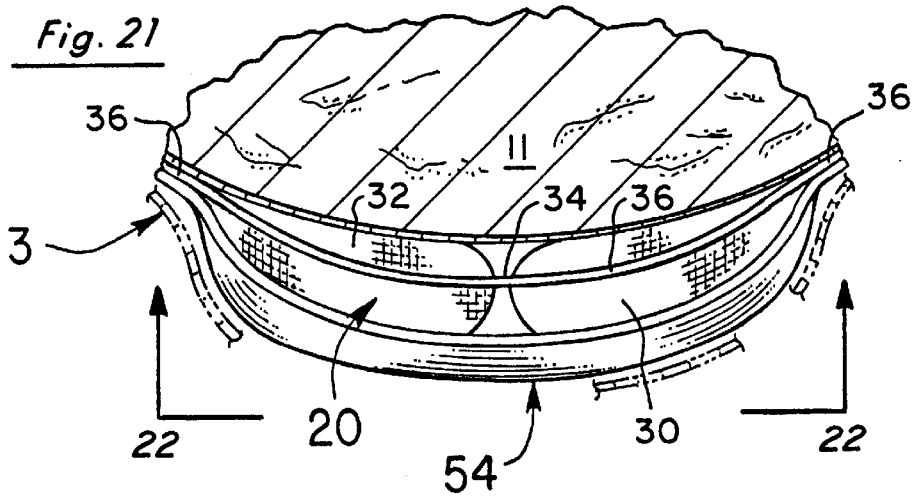
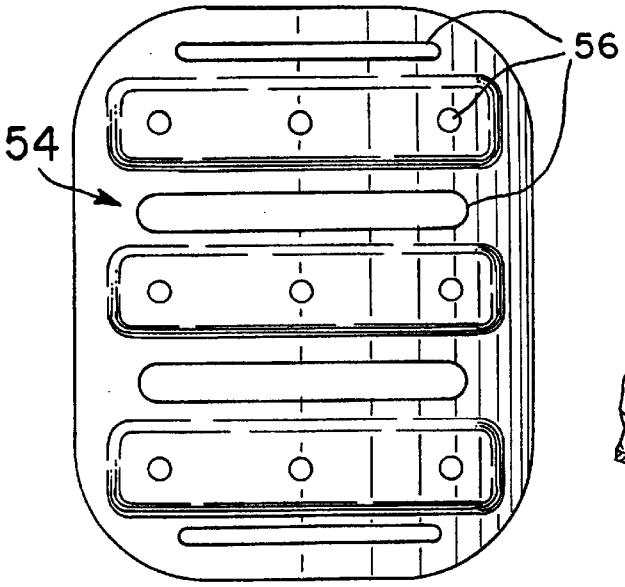
Fig. 22
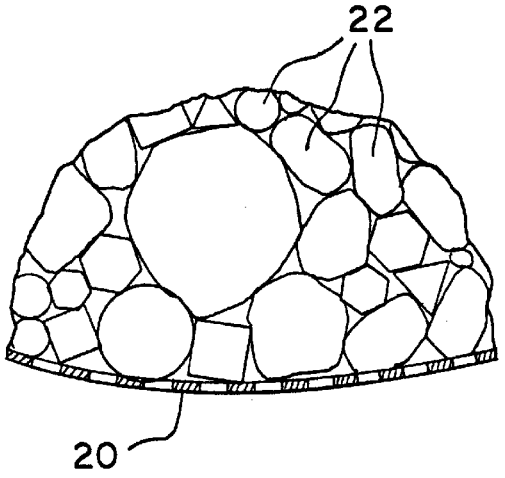
Fig. 23

Fig. 26
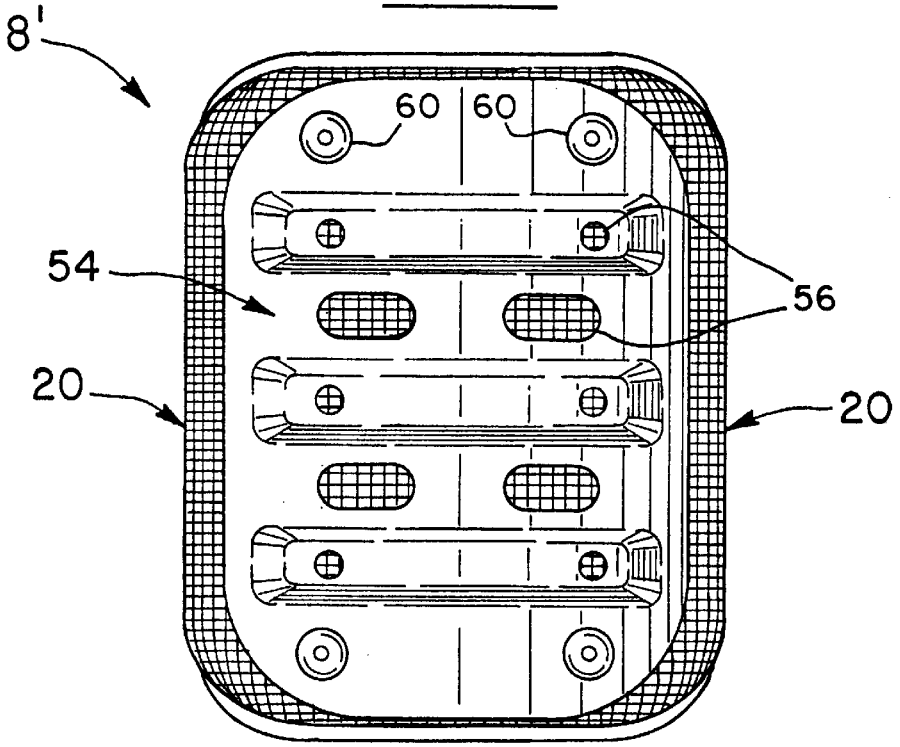
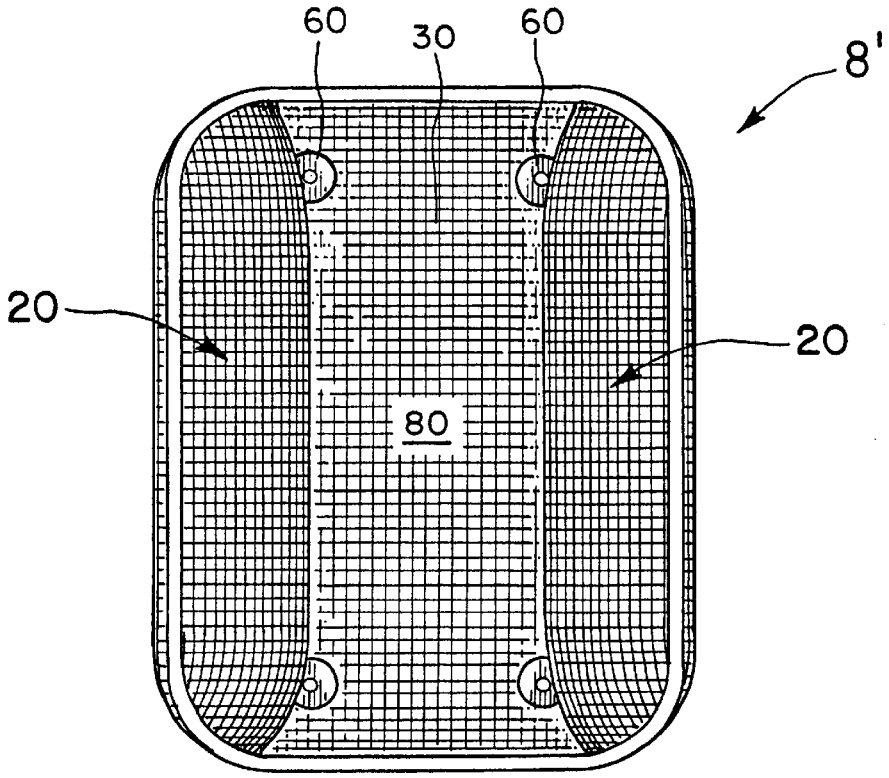
Fig. 27

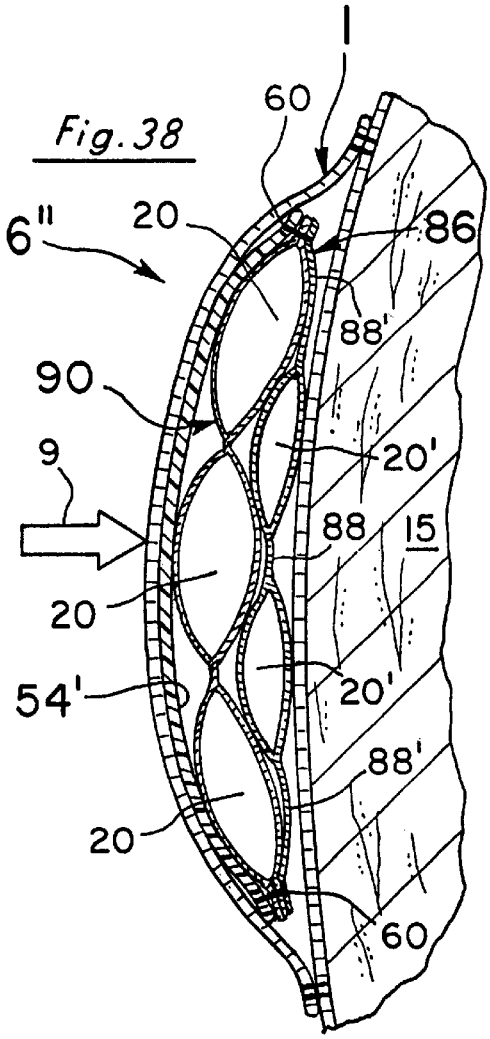
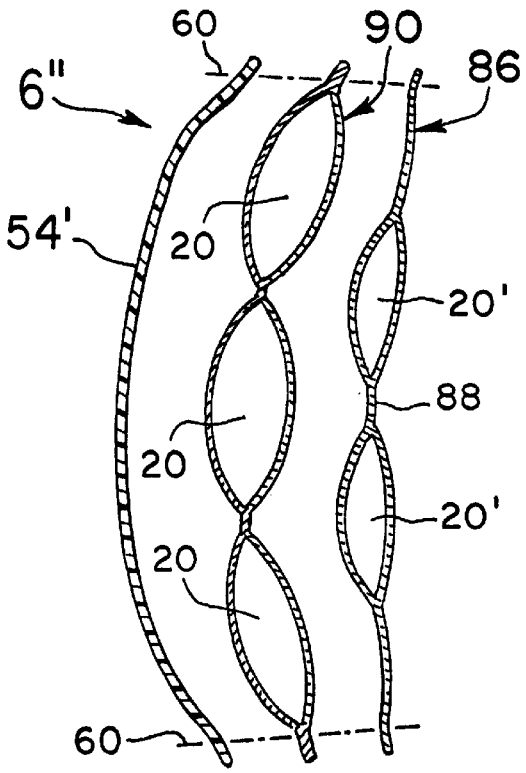
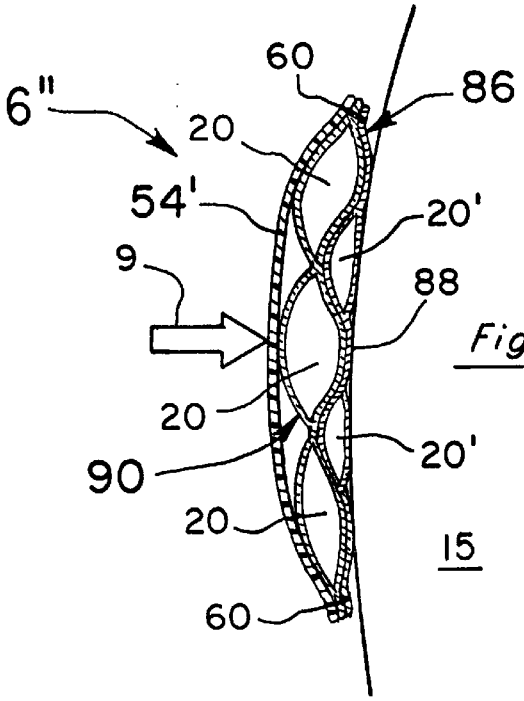
Fig. 40

PROTECTIVE PADDING FOR SPORTS GEAR

RELATED APPLICATIONS

This application is a continuation of U.S. patent application Ser. No. 09/506,507 filed Feb. 17, 2000 now U.S. Pat. No. 6,357,054, which is a continuation-in-part of U.S. patent application Ser. No. 09/226,311 filed Jan. 7, 1999, now U.S. Pat. No. 6,032,300, which is a continuation-in-part of U.S. patent application Ser. No. 09/158,088 filed Sep. 22, 1998, now U.S. Pat. No. 5,920,915.

BACKGROUND OF THE INVENTION

1. Field of the Invention

This invention relates to the field of padding and more particularly, to the field of protective padding for sports gear.

2. Discussion of the Background

Designing protective padding for sports gear presents numerous challenges. In addition to having the padding perform its primary function of repeatedly absorbing and dissipating high impact forces, such padding would ideally be lightweight, breathable, and washable. Further, it would preferably be easily integrated into sports gear such as jerseys, pants, and helmets as well as be adaptable for specialized uses such as removable knee and elbow pads. All of the above would be accomplished in a manner that would not unduly inhibit the athlete's movements and dexterity on the field.

Many prior art pads and padding techniques accomplish some but not all of these goals. For example, U.S. Pat. No. 4,343,047 to Lazowski uses loosely filled, lightweight beads in a breathable casing to form a helmet pad. The helmet pad easily conforms to the contours of the wearer's head and in use, the loose beads are designed to move or shift around relative to each other within the casing. The beads are also designed to be crushed to absorb and attenuate high impact loads and forces. Such crushable padding is essentially effective for only one application and one impact situation, much like a car airbag in an emergency. As a practical matter, such padding cannot be used for other athletic gear such as football pants with thigh and knee pads that must withstand and be effective under repeated blows and impacts without losing their integrity.

Other prior art pads use incompressible beads that are designed not to be crushed (e.g., British Patent No. 1,378,494 to Bolton, U.S. Pat. No. 3,459,179 to Olesen, and U.S. Pat. No. 4,139,920 to Evans). Still others use compressible beads that are also designed not to be crushed such as U.S. Pat. No. 3,552,044 to Wiele and U.S. Pat. No. 5,079,787 to Pollman. However, in each case, the beads are loosely packed to allow the beads to move or roll relative to each other in an effort to achieve maximum conformation to the shape of the particular body part. Wiele in this regard even lubricates his beads to enhance their flowability. The thrust of these underfilled pads as expressed by Olesen, Wiele, and Pollman is to achieve padding with the flow and conforming characteristics of liquid-filled pads, but without the undesirable weight of such heavy fillings. Liquid-filled pads also necessarily require waterproof casings that make them unduly hot in use as they do not breathe. While such pads of loosely filled beads essentially conform like a liquid, the underfilled beads in them have an undesirable tendency to move out of the way in use. This tendency reduces the thickness of the padding around the body part and can even allow the body part to bottom out in the pad. In such a case, the beads essentially move completely out of the way and the only protection left is simply the two layers of the casing for the pad. This is particularly true when used for impact padding where the blows tend to occur repeatedly at the same location. Such loose-filled pads for the most part are ineffective for such uses.

In the athletic field today, the standard padding used is one or more sheets or layers of foam. Foam in this regard has the distinct advantages of being lightweight and relatively inexpensive. For the most part, there are two types of such foam padding. The first is closed cell which has the advantage of not absorbing moisture or other fluids. However, layers of closed-cell foam tend to be stiff and do not conform well to the body, particularly when the athlete is active. They also do not breathe to dissipate body heat and generally cannot be sewn into or washable with the athlete's uniform. The second type of commonly used foam is opened cell. These foams tend to be softer and more pliable than closed cell foams; however, they absorb moisture and odor and generally need to be coated with a waterproof material (e.g., vinyl). This coating then makes the pads non-breathable and very hot.

With these and other concerns in mind, the padding of the present invention was developed and specifically adapted for use in sports gear. The padding of the present invention involves both overfilled pads (i.e., filled more than a simple gravity fill or 100% full) and pads with no more than a gravity fill. Both sets of pads can be used alone or with hard, outer shells; however, most of the overfilled applications do not use a hard, outer shell while most of the gravity filled (and under gravity filled) applications are preferably used in combination with a hard, outer shell. In the preferred embodiments of the overfilled, gravity filled, and under gravity filled padding, the adjacent beads within the pads preferably maintain their relative positioning in use (i.e., they do not flow or migrate relative to each other). The beads in this regard essentially maintain or stay in their positions relative to each other and just vary their degree or amount of compression. This in turn helps to prevent the pads from bottoming out in use. The present padding is lightweight, breathable, and washable. It can also be easily incorporated to protect a variety of body parts, all without unduly inhibiting the athlete's movements and actions. The padding is relatively simple and inexpensive to manufacture and can be easily integrated into nearly all sports gear.

SUMMARY OF THE INVENTION

This invention involves protective padding primarily intended for use in sports gear. In a first set of preferred embodiments, the pads include flexible, outer casings of porous, breathable, inelastic material overfilled with resilient, discrete beads of elastic material. The beads are initially in compressed states within the casing and place the outer, inelastic casing in tension. When a blow or force is applied, the beads are further compressed to absorb and dissipate the impact. Additionally, the applied blow or force will increase the tension in the outer casing to even further compress the elastic beads for better absorption and dissipation of the impact. In use, the porous pads are compressed and rebound to create a pumping effect that circulates air into and out of the pads drawing heat and perspiration from the athlete's body and keeping the athlete cool and dry. If desired, the pads can be secured directly to the athlete's jersey or other article of clothing to enhance this pumping effect as well as the dissipation of the force of any impact. In an alternate embodiment, the outer casing is made of an elastic material that is overfilled to its elastic limit to act in the manner of the preferred embodiments. In a second set of preferred embodiments, the outer casings of the pads are actually filled no more than a simple gravity fill (i.e., 100%) and preferably are underfilled (e.g., 90%) to less than a gravity fill. This second set of pads is preferably used in combination with a hard, outer shell. Variations of the basic features of the first and second sets of pads are also disclosed. All of the pads of the present invention are lightweight and washable and can be adapted and integrated into a wide variety of items.

BRIEF DESCRIPTION OF THE DRAWINGS

FIG. 4 is a further illustration of the pad of FIG. 2 showing its segmenting.

FIG. 5 is a cross-sectional view taken along line 5—5 of FIG. 4.

FIG. 6 illustrates the knee pad of FIG. 1 incorporating the padding technology of the present invention.

FIG. 7 is a cross-sectional view taken along line 7—7 of FIG. 6.

FIG. 8 is a cross-sectional view taken along line 8—8 of FIG. 6.

FIG. 10 schematically illustrates the increased compression forces applied by the casing as it is further tensioned by the applied blow.

FIG. 11 schematically shows the dissipation and reduction of the applied blow as received by the athlete's body.

FIG. 12 illustrates a pad of the present invention with a single pouch that has a substantially circular cross section.

FIG. 13 shows the sternum pad of FIG. 1 incorporating the padding technology of the present invention.

FIG. 14 is cross-sectional view taken along line 14—14 of FIGS. 1 and 13 showing the pouches of the pad substantially compressed to pump air out of them.

FIG. 15 is a view similar to FIG. 14 showing the pouches of the pad rebounding to their initial shape and volume to draw ambient air into them.

FIGS. 16 and 17 are views similar to FIGS. 14 and 15 with boundary portions of the pad attached to the jersey to further enhance the pumping action.

FIG. 18 illustrates an additional advantage of securing the pad to the jersey wherein the jersey is pulled or drawn in by the pad to further dissipate the force of any impact.

FIG. 19 schematically illustrates the multi-directional movement of air into and out of the pads of the present invention.

FIG. 20 illustrates one method of making the overfilled pads of the present invention.

FIG. 21 shows a pad according to the present invention used in combination with an outer, hard shell.

FIG. 22 is a view taken along line 22—22 of FIG. 21

FIG. 23 illustrates the use of discrete beads of different shapes and sizes.

FIG. 24 in this regard is a view taken along line 24—24 of FIG. 1 showing thigh padding constructed in accordance with this second set.

FIG. 26 is a view taken along line 26—26 of FIG. 24.

FIG. 27 is a view taken along line 27—27 of FIG. 24.

FIGS. 38–40 show further modifications to the basic structure of FIGS. 35–37.

DESCRIPTION OF THE PREFERRED EMBODIMENTS

Figure 1:
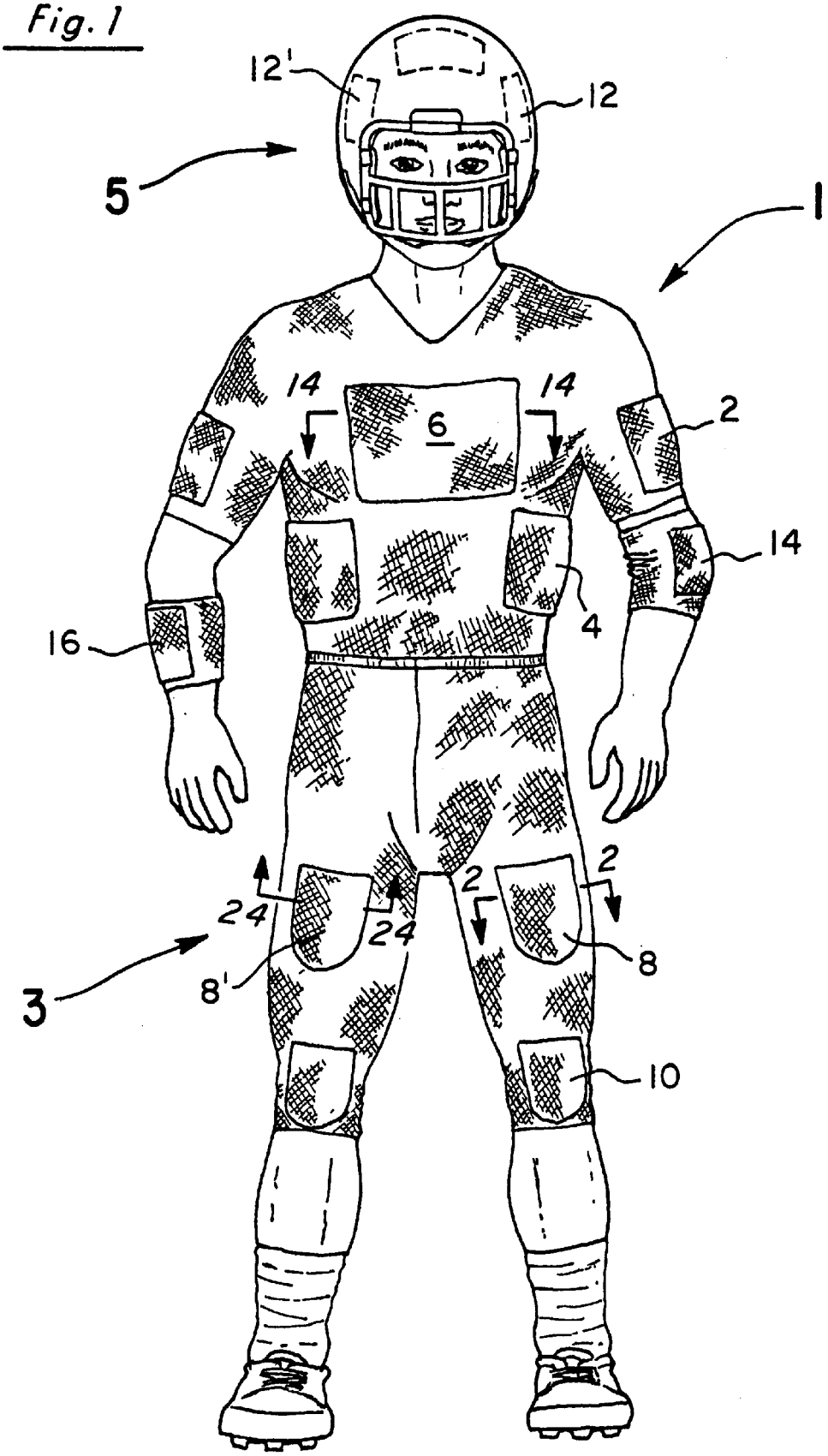
FIG. 1 illustrates the padding technology of the present invention adapted and integrated into sports gear for football.

FIG. 1 illustrates the padding technology of the present invention adapted and integrated into sports gear for football. The particular gear shown in FIG. 1 includes an under or liner jersey 1 with upper arm 2, rib 4, and sternum 6 pads. The illustrated gear also includes liner pants 3 with thigh 8 and knee 10 pads and helmet 5 with head pads 12. Liner gear such as jersey 1 and pants 3 are commonly worn by football players next to their bodies. Full shoulder pads and exterior or playing jerseys and pants are then worn over the liner gear and can also be padded according to the present invention. The current technology additionally can be easily adapted for use in nearly any and all other types of padding including separate and removable ones such as elbow 14 and forearm 16 pads in FIG. 1.

Figure 2:
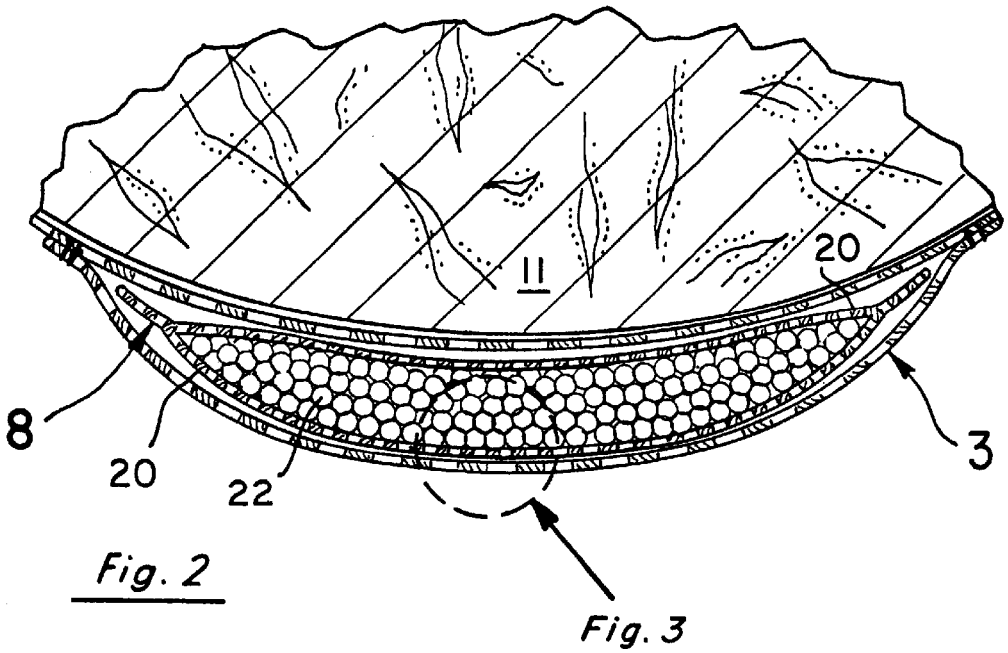
FIG. 2 is a cross-sectional view of the thigh pad of FIG. 1 taken along line 2—2 of FIG. 1.

The basic structure of the first set of protective pads of FIGS. 1–23 of the present invention as typified by the thigh pad 8 in FIGS. 1 and 2 includes an outer casing 20 (see FIG. 2) which is overfilled with beads 22. In use, the entire pad 8 is then received or sewn into a pocket in the pants 3. The outer casing 20 of the pad 8 is preferably made of a porous, breathable, and flexible material that is substantially inelastic. In the preferred embodiment, the casing 20 is a plastic mesh of a substantially waterproof material as polypropylene which is heat sealable. Other substantially inelastic, porous, and flexible materials could also be used if desired such as woven or unwoven fiberglass, polyester, or nylon yarns preferably coated with PVC to make them heat sealable and waterproof. The casing 20 is overfilled with soft, resilient, discrete beads 22 of elastic material. The beads 22 are also preferably made of lightweight and waterproof material (e.g., a closed-cell foam such as polypropylene). In this manner and although the pad 8 is extremely porous, the casing 20 and beads 22 of the pad 8 do not absorb water, other liquids, or odors and the entire pad 8 can be washed and dried with the pants 3 and the rest of the gear of FIG. 1. The beads 22 can be of a variety of different shapes and sizes but preferably are spherical beads ranging in diameter from about 0.05 to about 0.5 inches. Depending upon the application, the beads could be smaller or larger but would still have the operating characteristics discussed below. The pores of the outer casing 20 are preferably as large as possible without allowing the beads 22 to pass through them during use.

The beads 22 are overfilled in the casing 20 meaning that the fill is higher than a simple gravity fill. Consequently, substantially all of the resilient beads 22 are in compression. The actual overfill above 100% can be up to 160% or more but is preferably about 120%. As illustrated in the enlarged view of FIG. 3, this leaves the compressed, spherical beads 22 of the preferred embodiments slightly distorted or flattened on the abutting portions 24 while the spaced-apart portions create the interstitial spaces 26 therebetween. Each bead 22 is thus compressed to under 100% to about 40% of its relaxed, uncompressed volume. Preferably, the compression is about 80% of the relaxed volume. The total volume of the interstitial spaces 26 under a gravity fill can be on the order of 35% of the casing volume. With the beads 22 initially compressed, this interstitial volume is then less than about 35% down to about 5% of the volume of the casing 20. Preferably, the interstitial volume is about 25%–30% of the casing volume with the compressed beads 22 then occupying the remaining volume of the casing 20.

The opposing portions 30 and 32 of the casing 20 in the thigh pad 8 as shown in FIGS. 4 and 5 are preferably segmented or joined by seams 34. Such segmenting or joining of the opposing portions 30 and 32 within the pad boundary 36 helps to prevent the pad 8 from ballooning. Depending upon the spacing of the segments 34, the cross-sectional shapes of the individually padded areas or pouches of the pad 8 can be varied to create nearly circular ones like 38 in FIG. 5 or more elongated ones such as shown in FIG. 2. (For clarity, the beads 22 are illustrated in FIG. 5 in only one of the pouches 38 but the beads 22 would be in all of the pouches 38.) The segmenting or joining at linear seams 34 also provides predetermined fold lines or patterns to help the pads conform better to the curved shapes of the user's body such as to his or her thigh 11 in FIG. 5. Such conformation gives the thigh pad 8 less of a tendency to rotate or otherwise move out of place. This is particularly important for the pads protecting joints such as the knee pad 10 in FIGS. 6–8. As illustrated the knee pad 10 is provided not only with a vertical segment or seam 34 but also with horizontal seams 40 and spot or dot attachments 42. Vertical segment 34 in FIG. 6 helps the knee pad 10 to conform about the knee 13 (FIG. 7) while the substantially perpendicular or horizontal segments 40 (FIG. 8) aid the pad 10 to bend with the natural flex of the knee joint. Spot or dot attachments 42 help to keep the pad 10 from ballooning.

Figure 3:
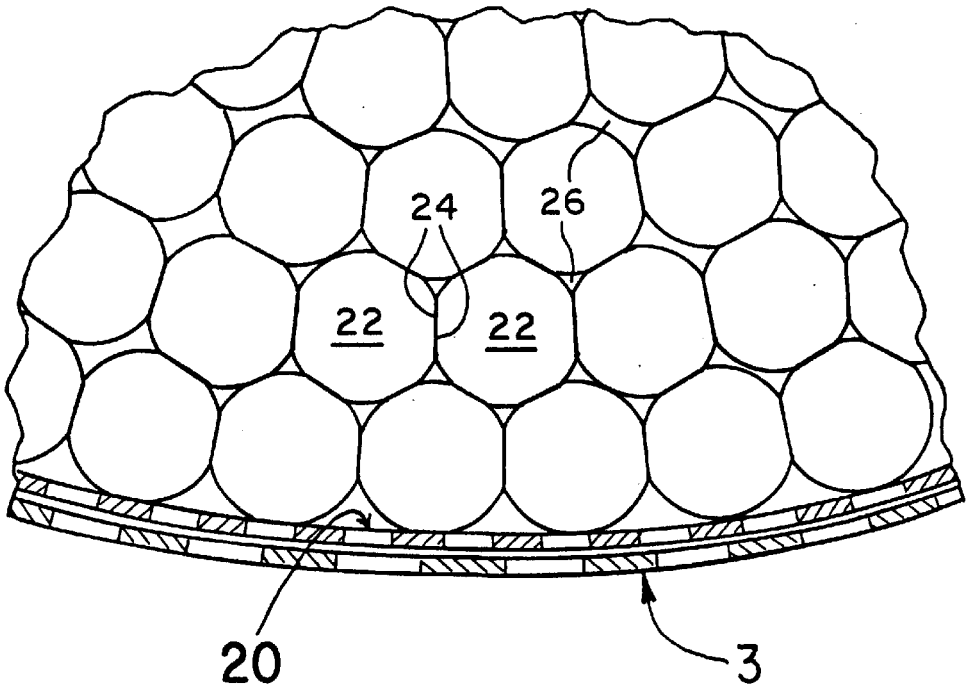
FIG. 3 is an enlarged, cutaway view of the pad of FIG. 2 showing the initially compressed state of the beads in it.

The initially compressed beads 22 of FIGS. 2 and 3 within the casing 20 serve to place the outer, inelastic casing 20 in tension. This has the beneficial result of aiding in the absorption and dissipation of any blow applied to the pad. More specifically and referring to FIG. 9 (in which only the pad 8 and athlete's thigh 11 are shown for clarity), any impact or blow 9 to the casing 20 will depress the inelastic casing 20 at the point of the blow 9. This depression in turn will draw in the casing 20 immediately to the sides 44 and 46 of the blow 9. The force applied by the blow 9 in FIG. 9 will then be absorbed and dissipated by the beads 22' directly under the blow 9 and by the surrounding beads 22", which will be further compressed by the increased tension in the casing 20 as explained below.

Figure 9:
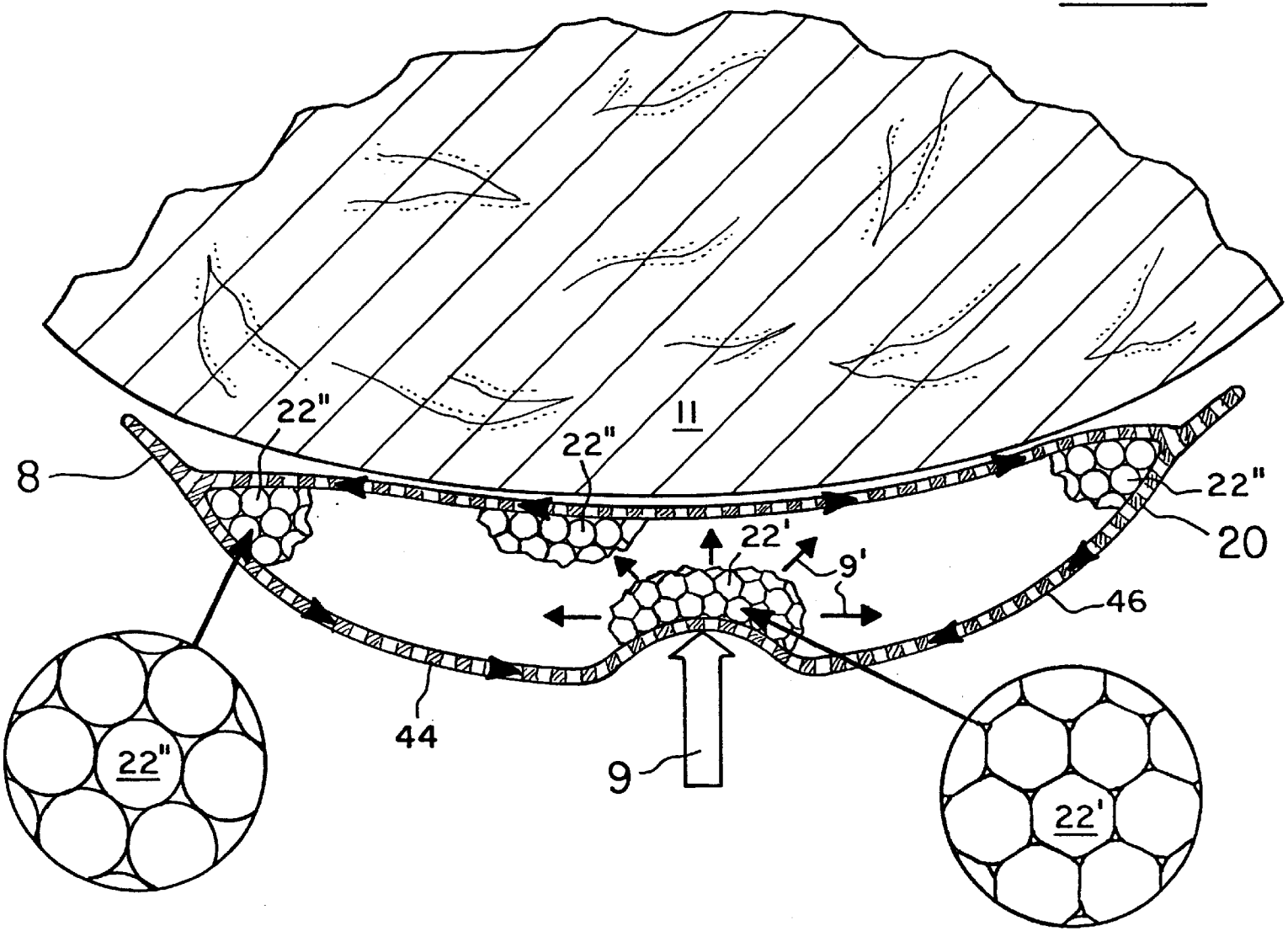
FIG. 9 is an enlarged view of the pad of FIG. 2 initially receiving a blow or impact.

More specifically, the beads 22' directly under the blow 9 in FIG. 9 will first and foremost be further compressed by the blow 9 from their initially compressed state as in FIG. 3 to that of FIG. 9. These further compressed beads 22' at the point of blow 9 in FIG. 9 will then send or radiate compressive forces 9' outwardly to the remaining beads 22". These remaining or surrounding beads 22" in turn will be further compressed from their initial states by the radiating forces 9' acting on the beads 22" against the retaining force of the inelastic casing 20. This radiating action is essentially an inside-out one. Additionally, and because the casing 20 is inelastic and does not stretch, the blow 9 will draw in the casing 20 immediately to the sides 44 and 46 of the blow 9. This movement of sides 44 and 46 will reduce the casing volume and further tension the casing 20. It will also cause the casing 20 to increase the compression of the beads 22", essentially by applying forces 9" as illustrated in FIG. 10 from the outside-in. In these manners, the initial force of the blow 9 will be absorbed and dissipated within the pad 8 and the forces actually transferred to the athlete will be greatly reduced as schematically illustrated by forces 19 in FIG. 11. Preliminary tests show this reduction to be quite significant over the currently most popular pads and padding. Further, because of the resiliency of the discrete beads 22' and 22" in FIG. 9, the propagation of the force through the pad 8 is slower than through a pad, for example, composed of simply a layer of foam. This slower propagation speed helps to further dissipate the impact.

In use, the pads of the present invention offer still other unique advantages. Because the pads are overfilled and the casings initially tensioned, the pads are biased toward a first shape and volume. That is, when unimpeded by any external forces, each pad will assume a first, predetermined shape such as the symmetrical one illustrated in FIG. 12. Depending upon the amount of overfill of the beads 22 and other factors such as the relative stiffness of the casing 20 and the relative spacing of any segments 34, the unrestrained, single pouch 50 of the pad in FIG. 12 tends toward a nearly circular cross section. Even under mild restraints such as the pants 3 on the motionless athlete of FIGS. 1 and 5, the multiple pouches 38 of the thigh pad 8 in FIG. 5 are still individually biased toward a first or free shape such as in FIG. 12. Such bias for the most part is provided by the outwardly directed forces of the compressed beads 22 acting against each other and against the flexible but inelastic, outer casing 20.

In a like manner, even the more flattened or elongated pouch of pad 8 in FIGS. 2 and 10 is biased toward a first shape and volume. Consequently, if a blow such as 9 in FIG. 10 is delivered compressing the pad 8 (as shown in dotted lines in schematic FIG. 10), the pad 8 upon dissipation of the blow 9 will automatically rebound to the original shape and volume shown in solid lines in FIG. 10. (For clarity, only the athlete's thigh 11 and the elongated pouch of pad 8 are shown in this schematic FIG. 10.) Because the casing 20 is porous and breathable and because the compressible beads 22 form interstitial spaces 26, this action on the pad 8 will have a desirable pumping effect. Such effect will force or pump air out of the pad 8 during the compression of blow 9 and draw in ambient air during the return or rebound toward the original shape.

This pumping effect also occurs with any natural movement of the athlete that tends to further compress and then release the pad (e.g., flexing and unflexing the knee in FIG. 8 during running). Such movement, as with a blow, first compresses the beads 22 further and reduces the total volumes of the casing 20 and the interstitial spaces 26. The resilient beads 22 then rebound to their initial state and volume returning the casing 20 and interstitial spaces 26 to their original volumes. This action is a pumping one and has its most beneficial effect around the jersey 1 to help dissipate and draw or wick away the athlete's body heat and perspiration. More specifically and referring to the chest or sternum pad 6 of FIGS. 1 and 13, the pad 6 would typically have a plurality of individual, completely compartmentalized pouches 50 (see FIG. 13). These individual pouches 50 would be separated by vertical and horizontal seams 34 and 40. In use as illustrated schematically in FIG. 14 and 15 (in which the pouch beads are not shown for clarity), the pouches 50 of the pad 6 alternately expel and draw in air. That is, at maximum inhalation or movement, the lateral or side-by-side array of pouches 50 in the jersey pocket 1 in FIG. 14 would assume compressed positions or shapes pumping air along with body heat and perspiration out of the pouches 50 and through the porous, mesh jersey 1. During simple breathing, this compression is caused primarily by the already tightly fitting jersey 1 being drawn even tighter about the athlete's chest 15 during inhalation. Upon exhaling, the pouches 50 naturally return or rebound to the positions of FIG. 15 drawing or pumping in ambient air. With each breath and/or movement, the process is repeated, cooling and drying the athlete's body.

To further enhance the pumping effect of the pads of the present invention, boundary or other spaced-apart portions of the pads can be secured if desired to move with the particular article of clothing such as jersey 1. For example, by actually sewing or otherwise securing opposing boundary portions 36' of the pad 6 in FIGS. 16 and 17 to spaced-apart portions of the flexible jersey 1, the stretch or pull of the elastic jersey 1 at 51 during even normal breathing will enhance the contraction of the pad 6 (FIG. 16) and its overall pumping action (FIGS. 16–17). Such securing also helps to keep the particular pad firmly and properly in place in the jersey 1 or other article or articles of clothing (such as items 3, 5, 14, and 16 of FIG. 1, or similar ones).

Further, the securing of the pad such as 6 in FIGS. 16 and 17 to the jersey 1 integrates the jersey 1 into the pad 6 and in essence makes the jersey an extension of the pad casing 20. Consequently, during an impact 9 as in FIG. 18, the casing 20 reacts in the manner of FIG. 9 drawing in the casing sides 44 and 46 immediately adjacent the blow 9; and, because the inelastic casing 20 is secured at each side 36' to the jersey 1, the jersey 1 is also drawn in at 52. The jersey 1 about the athlete's chest 15 then acts with and under the influence of the casing 20 to further dissipate the force of the impact 9. The impact 9 in FIG. 18 is shown striking the far left pouch 50 for illustrative purposes. However, depending upon where the impact strikes across the pad 6 and how broad the impact is, the jersey 1 would be pulled or drawn in to different degrees from all directions or sides 36' about the pad 6. If the pad 6 is secured to the jersey 1 as in FIGS. 16–17, it can be done so directly without the need to form a pocket in the jersey 1 as in these FIGS. 16–17.

It is noted that FIGS. 16 and 17 schematically illustrate the pumping action of the pad 6 with arrows directed primarily away from and toward the athlete's chest 15. However, the pads of the present invention including pad 6 with pouches 50 in FIGS. 16 and 17 are extremely porous in all directions. Consequently, as schematically shown in FIG. 19, the air moving into and out of the pouch 50' of pad 6' (and every pad of the present invention) travels in all directions. In contrast, for example, sheets of closed-cell foam that are perforated in the fashion of swiss cheese may pass air through the holes but cannot pass air laterally through the foam sheet. To the extent the sheet is made of open-celled foam to pass air in all directions, it then has the distinct disadvantage of absorbing moisture and odor.

As discussed above, the prestressed or initially compressed condition of the elastic beads 22 in the free state of FIG. 12 tensions the inelastic, outer casing 20. In use, this also helps to prevent the beads 22 from moving relative to each other. The beads 22 in this regard essentially maintain or stay in their positions relative to each other and just vary their degree or amount of compression. Consequently, the overfilled pads of the present invention will not bottom out in use. This is an important feature of the pads, particularly as used in sports gear. Comfort of the pad against the athlete's body is also a concern. To the extent the casing 20 is made of relatively stiff material or material that tends to be abrasive or irritating to the athlete's skin, the jersey 1 in FIGS. 14 and 15 acts as a soft barrier to the casing 20. In other applications such as forearm or shin guards, an additional layer of soft material could be added if desired to the pads of the present invention between the casing 20 and the athlete's body.

The overfilling of the pads to compress the beads 22 and tension the outer casing 20 can be accomplished in a number of manners. The preferred and simplest method is to substantially, or completely, gravity fill the casing 20 as shown in solid lines in FIG. 20. The opposing sides 30 and 32 of the casing 20 can then be depressed or pinched to form the segment 34 (shown in dotted lines in FIG. 20). Thereafter, the segment 34 can be joined by heat sealing the sides 30 and 32 of the casing 20 together or by some other method such as sewing, stapling, or riveting. The segment 34 in this regard can extend partially across the pad as in FIGS. 4 and 6 or completely across the pad as in FIGS. 13–15 to make separate and distinct pouches 50. Single or unsegmented pads such as the pad in FIG. 12 can be made by simply cutting the segmented pad of FIG. 20 along the joined portion or seam 34 to form separate, individual pads. Other techniques to overfill the pads could also be used such as blowing, screwing, or ramming the beads under pressure into the pad to compress the beads and sealing the pad shut while the beads remain compressed. Multiple compression steps can also be performed as for example initially compressing the beads 22 by one of the above techniques and then further compressing them by adding more linear segments 34 or spot joining the opposing sides 30 and 32 of casing 20 with staples or rivets.

The padding technology of the present invention is equally adaptable for use under hard, outer shells such as those normally used in football shoulder pads and thigh pads. In adding an outer, hard shell 54 as illustrated in FIGS. 21 and 22, the shell 54 is preferably well perforated (see perforations 56 in FIG. 22) so as not to unduly reduce the breathability of the underlying pad 8. In use, the pad 8 with the outer, hard, porous shell 54 essentially operates as described above except that the initial impact force is immediately dissipated by the shell 54 and spread or applied to the pad 8 across a larger area than in the case of FIGS. 9–11. Lighter, less hard coverings or outer layers could also be used in place of the shell 54 if desired such as an additional mesh layer of relatively stiff material. The stiffness of the mesh of the casing 20 can also be varied as desired to be relatively soft or even approach the stiffness of a hard shell like 54. The stiffer the casing 20, the more it then acts like a hard shell 54 to spread out and dissipate the blow. When a hard shell 54 is used, it has been found desirable to use relatively soft beads 22 beneath the shell 54 so the overall padding does not become too hard. This is particularly advantageous in sports such as hockey in which nearly all the pads will have hard, outer shells 54. In such cases, the fact that air moves into and out of the pads in all directions (as schematically shown in FIG. 19) becomes very important as the hard shell 54, no matter how perforated or porous it is, tends to restrict air flow through it. However, with the pads of the present invention, the air movement then simply moves laterally or in all of the remaining directions not inhibited by the shell 54. In contrast as discussed above, closed-cell foam sheets perforated like Swiss cheese will have any air flow blocked by the shell and air cannot move laterally through the sheet. If the foam is made of open-celled foam, air may flow around the shell but the foam will then absorb moisture and odors.

While several embodiments of the present invention have been shown and described in detail, it is to be understood that various changes and modifications could be made without departing from the scope of the invention. For example, as mentioned above and illustrated in FIG. 23, the beads could be of different sizes and shapes (e.g., spheres, cubes, oblongs, pyramids, and cylinders). In this regard, it has been found with beads of closed-cell polypropylene, for example, that it is preferred to use smaller diameter beads (e.g., 0.125 inches) packed fairly tightly (e.g., 140% overfill) for areas in which impact absorption is paramount (e.g., knee). Conversely, larger diameter beads (0.25 inches) of polypropylene with less compaction (e.g., 110%–120%) have been found to work better for areas in which breathability is of primary importance, such as in the chest area, to dissipate the athlete's body heat. Such larger diameter beads of polypropylene also tend to be softer than smaller diameter ones. Other factors such as the stiffness of the casing 20 as discussed above can also be varied as desired. In this manner, pads using the technology of the present invention can be custom designed not only for particular uses but also for particular individuals.

Further, and although the casing 20 is preferably overfilled only with compressible beads 22, portions of the fill could be other items with other properties (e.g., incompressible) as long as the fill was predominantly of the preferred, resilient, elastic members or beads 22 to give the pads the desirable characteristics discussed above. Additionally, the casing 20 has been discussed above as being preferably made of inelastic material. However, the casing 20 can be made of an elastic material if desired that was also flexible, porous, and breathable. The elastic casing 20 would then be preferably overfilled and expanded substantially to its elastic limit to place the beads 22 in compression and the stretched casing 20 in tension. The casing 20 would then act substantially in the manner of an inelastic one and the overall pad would perform substantially as discussed above and as illustrated in FIGS. 1–23. It is further noted that the padding of the present invention has been primarily disclosed as adapted for use in sports gear but it is equally adaptable for use wherever foam and other padding are used. For example, the padding technology of the present invention could be used as pads for fences, poles, trees, and walls as well as in industrial applications such as elevators and vehicle bumpers.

Figure 24:
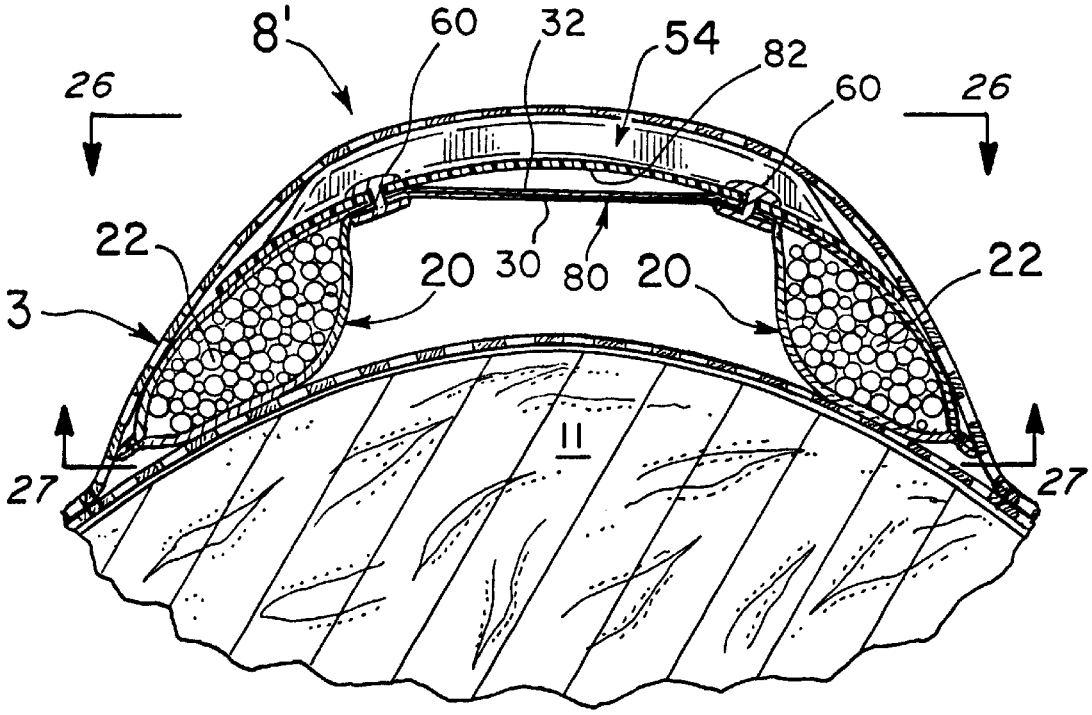
FIG. 24 illustrates a second set of protective padding of the present invention in which the pad casings are preferably underfilled (or at least filled no more than a gravity fill) and are preferably used in combination with hard, outer shells.
Figure 25:
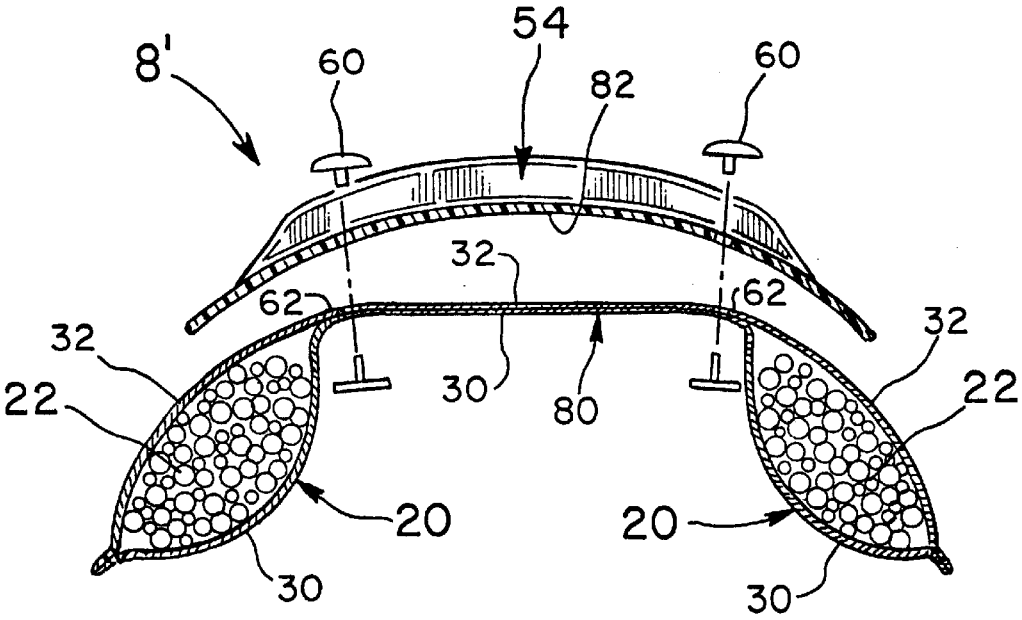
FIG. 25 is an exploded view of the thigh padding of FIG. 24.

Additionally, as best seen in FIGS. 24 and 25, a second set of protective padding of the present invention involves initially filling the inelastic casings 20 to no more than a simple gravity fill (i.e., 100%) and preferably underfilling the casings 20 to less (e.g., 90%) than a gravity fill. The casings 20 are then untensioned and substantially all of the beads 22 are uncompressed in the casings 20. This second set of protective padding with underfilled casings 20 (see FIGS. 24–27) is preferably used in combination with a hard, outer shell such as 54. Like the first set of protective padding of FIGS. 1–23, the casings 20 are preferably made of porous, breathable, and flexible material which is substantially inelastic. Similarly, the casing material is preferably a plastic mesh of a substantially waterproof material (e.g., polypropylene) that is heat sealable. The beads 22 are also preferably made of waterproof material (e.g., closed-cell, foam beads such as polypropylene). Like the pads of the first set of FIGS. 1–23, the casings 20 and beads 22 themselves do not absorb water; however, the overall pads themselves are extremely porous and breathable to help keep the athlete's body cool. In this regard, both air and water will easily pass or flow through the pad but will not be absorbed by any of its components, including the casings 20 and beads 22 of the pads.

FIG. 24 in this regard is a view taken along line 24–24 of FIG. 1 illustrating this second set of padding in use as thigh padding 8'. As shown, the padding 8' of FIG. 24 includes a hard, outer shell 54 to which the pair of casings 20 are attached by rivets 60. More specifically, as illustrated in the exploded view of FIG. 25, the two layers or portions 30 and 32 of the casings 20 are preferably heat sealed or sewn at 62 to form somewhat of a pontoon shape. Each pontoon casing 20 is then initially filled to no more than a gravity fill (i.e., 100%) and is preferably slightly underfilled (e.g., 80%–95% of a simple gravity fill). The casings 20 are preferably attached adjacent the joined areas 62 to the hard, outer shell 54. The shell 54 like the one of FIG. 22 is perforated at 56 (see FIG. 26) to be very porous so as not to unduly reduce the breathability of the overall padding 8'.

Figure 28:
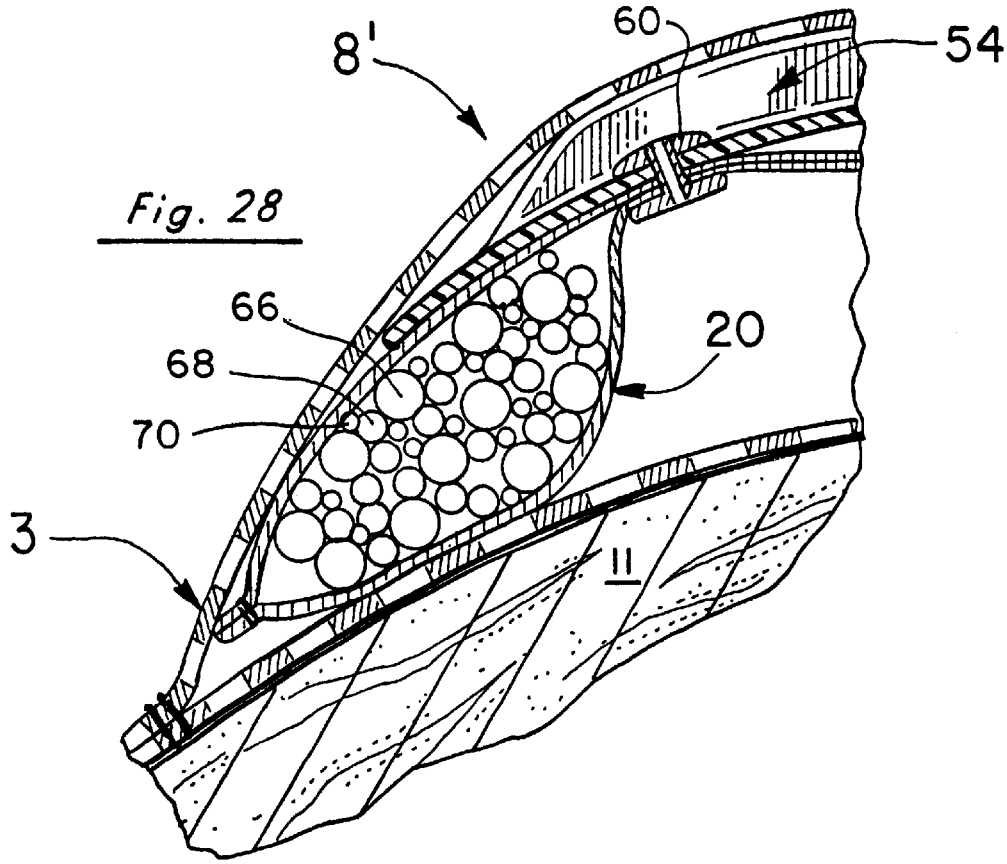
FIG. 28 is an enlarged view of one of the beaded casings of FIG. 24.
Figure 30:
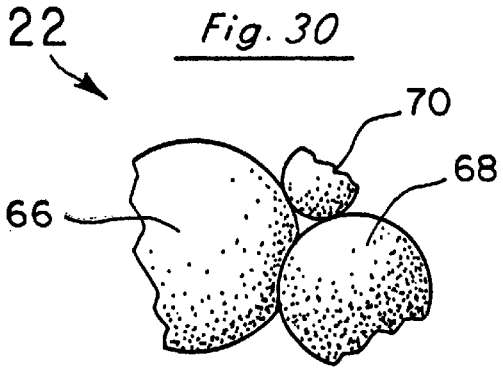
FIGS. 30–32 illustrate the manner in which the differently sized beads progressively compress to progressively absorb forces applied to them.
Figure 31:
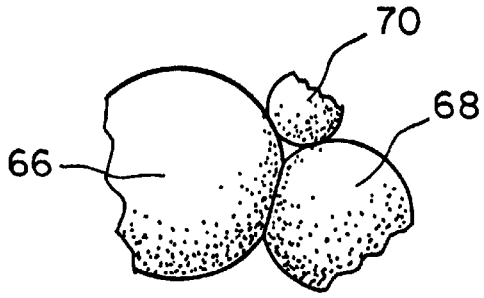
Figure 32:
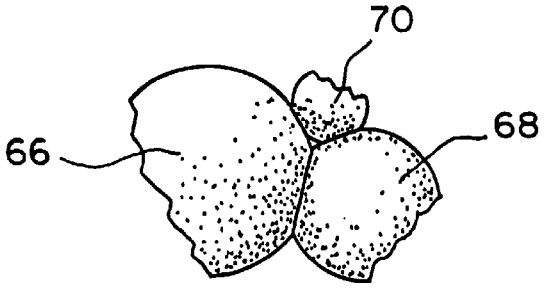

In the preferred embodiments of the second set of protective padding as typified by the padding 8' of FIGS. 24–27, the beads 22 are preferably blended and are a mix of different shapes as in FIG. 24 and/or at least two and preferably three, differently sized beads 66, 68, and 70 (see FIG. 28). The beads 66, 68, and 70 are preferably of grossly different sizes, as for example spheres with relative diameters of 1:2:3 (e.g., 1/12:1/6:1/4 inches). When the beads are made of the same material (e.g., closed-cell polypropylene or polyethylene), the expanded size differences normally translate directly into varying degrees of softness (e.g., ease of compression). The largest beads 66 are then softer (e.g., have a lower spring coefficient) and compress more easily than the medium-sized, denser beads 68 which in turn are softer and compress more easily than the smallest and densest beads 70. Consequently, in use when a force or blow 9 is applied as in FIG. 29, the beads 66, 68, and 70 will normally progressively compress from beads 66 (FIG. 30), to beads 68 (FIG. 31), to beads 70 (FIG. 32) to progressively absorb the blow. However, if the applied force or blow 9 is fairly light, it may be that only the largest beads 66 are compressed. Similarly, if the force 9 is an intermediate one, beads 66 and 68 may only be compressed. Heavy forces 9 would then progressively compress all of the beads 66, 68, and 70.

Regardless of the size of the impact force 9 and/or how many differently sized beads 66, 68, and 70 are compressed, the combined effect of the hard, outer shell 54 and relatively soft beads 66, 68, and 70 is at least two fold. First, it spreads out the applied force 9 and second, it extends or delays the transfer time of the applied force 9 through the padding 8' to the athlete's thigh 11. That is, the geometry of the hard shell 54 over the casings 20 in FIG. 29 will serve to spread out and dissipate the force 9 from the relatively small, impact area to the larger contact area between the casings 20 and the athlete's thigh 11. However, equally important in the overall design of the padding 8' of FIGS. 24–29 is the softness of the beads (whether or not a mix) in the casings 20. The beads in this regard are preferably soft enough that the initially reduced forces at 72 between the hard, outer shell 54 and beaded casings 20 in FIG. 29 will significantly compress the beads. Otherwise, the load of the impact force 9 will be transferred too quickly through the beaded casings 20 to the thigh 11 causing increased damage and injury (e.g., bruising). In contrast, the beaded casings 20 in the preferred embodiments of FIGS. 24–32 are as soft as possible to thereby be compressed by the forces 72 and extend the transfer time of the forces through the padding 8' as long as possible.

Figure 33:
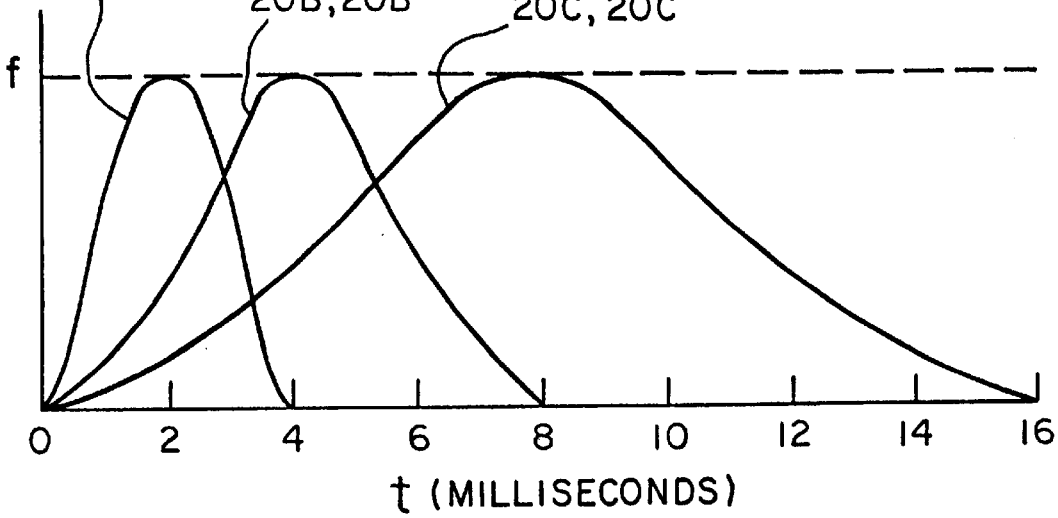
FIG. 33 schematically shows how softer beads and less filled casings delay the transfer time of the applied force to the athlete's body.

The empirical benefits of this extending or delaying of the transfer time of the forces through the padding 8' are to lessen the damage and injury to the athlete's body. This is schematically illustrated in FIG. 33. In this FIG. 33, the beaded casings are made progressively softer (e.g., more easily compressed) from casings 20A to 20B to 20C. Except for the softness of the beads, the beaded casings 20A, 20B, and 20C are otherwise identical. As shown, the transfer time t of the same, peak load or force f to the athlete's body for the softest, beaded casing 20C is essentially twice as long (e.g., 8 milliseconds) as for the less soft, beaded casing 20B (e.g., 4 milliseconds). Similarly, the least soft (i.e., hardest or firmest), beaded casing 20A has the quickest transfer time (e.g., 2 milliseconds) and is potentially the most damaging to the athlete. In making the beaded casing 20C as soft as possible, for example, the largest beads 66 in the mix would preferably be compressible with as little force as possible to 50% and preferably 20% of their relaxed or uncompressed volume. If made of the same material (e.g., polypropylene) as discussed above, the smaller beads 68 and 70 would not be as soft (e.g., would not be as easily compressed for any given force) but they still would preferably be very soft, easily compressible beads. Preferably, the beads are always made of a waterproof material (e.g., closed-cell foam of polypropylene or polyethylene).

FIG. 33 also schematically illustrates the benefit of underfilling the casings 20 (e.g., 80%–95% of a simple gravity fill). More specifically, FIG. 33 shows the force transfer delay for the thigh padding 8' configuration such as in FIG. 24 using an overfilled casing 20A', a gravity or 100% filled casing 20B', and an underfilled (e.g., 90% of a gravity filled) casing 20C'. Except for the degree of fill, the casings 20A', 20B', and 20C' in FIG. 33 are otherwise identical. The combined teachings of FIG. 33 is that in padding using a hard, outer shell 54, casings 20 that are underfilled (e.g., 90%) with the softest beads are preferred. This is not to say that overfilled casings 20 as in FIGS. 1–19 are not desirable when the protective padding has no hard, outer shell 54. In fact, such overfilled casings 20 are preferable over gravity filled or underfilled casings 20 if used alone without a hard, outer shell 54. However, when used with such a shell 54, overfilled casings 20 are less desirable than gravity filled ones which in turn are less desirable than slightly underfilled (e.g., 80%–95%) ones due primarily to the delayed transfer time effect discussed above.

Figure 29:
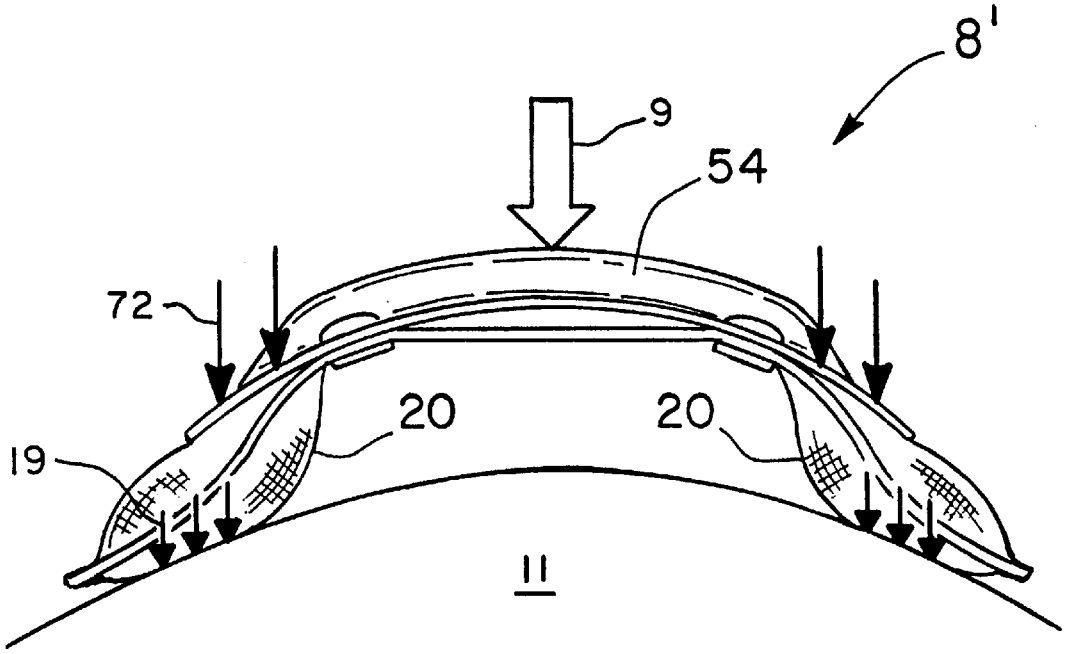
FIG. 29 is a view similar to FIG. 24 showing the result of the thigh padding of FIG. 24 receiving a blow or force.

In actual operation, the final stages of the transfer of the impact force 9 in FIG. 29 to the athlete's thigh 11 with an initially underfilled (e.g., 90%) casing 20 is essentially the same as discussed in regard to the overfilled casing 20 of FIGS. 9—11. The same is true for a gravity filled one. In other words, the underfilled or gravity filled casings 20 under a hard, outer shell 54 will distort to a smaller volume shape under the applied force 9 (compare the casings 20 of FIG. 24 to the more flattened ones of FIG. 29). This will essentially compress the beads 66, 68, and 70 and tension the inelastic casing 20 to thereafter operate in the manner of the initially overfilled casing 20 of FIGS. 1–23. However, as discussed above, the underfilled (and to a lesser extent the gravity filled) casings 20 will reach this state more slowly than an initially overfilled casing 20 (using the identical beads or bead mix).

Returning to the blending or mixing of bead sizes 66, 68, and 70 in FIG. 28, this offers several advantages. As discussed above, it creates a gradient of softnesses and a progression of bead compressions from the largest beads 66 down to the smallest beads 70. Additionally, and perhaps more importantly, such blending or mixing inhibits migration or movement of the beads relative to each other. This is true for overfilled, gravity filled, and underfilled casings 20 but is particularly important for underfilled ones. By blending the beads, the volume of the individual voids or interstitial spaces is reduced. This in turn inhibits bead migration by physically making it more difficult for the beads 66, 68, and 70 to move relative to each other as there simply is less space or room to do so. The volume of such voids or interstitial spaces might, for example, be reduced 10% to 25% by such mixing. The result is that adjacent beads within each pad casing 20 assume initial positions relative to each other after the casing 20 is initially filled and maintain their initial, relative positioning in use (i.e., the beads do not flow or migrate relative to each other). The beads in this regard essentially maintain or stay in the same, initial positions relative to each other and just vary their degree or amount of compression. This in turn helps to prevent the pad casings 20 from bottoming out in use. Such migration can also be inhibited by increasing the surface friction (e.g., roughness) of the beads (whether a mix or not) and by increasing the surface friction of the material of the outer casing 20 itself. The mesh size of the material of the outer casing 20 can also be varied so that portions of the beads actually protrude or stick through and become caught up in the mesh. Using stiffer material for the casings 20 will also help as will segmenting. Nevertheless, even without blending, it is noted that the beads will tend to clump, plug, or bridge against each other as illustrated in the lower left portion of FIG. 28. This not only inhibits migration of the beads but also helps create desirable voids in underfilled casings, as also best illustrated in the lower left portion of the underfilled casing 20 of FIG. 28.

Figure 34:
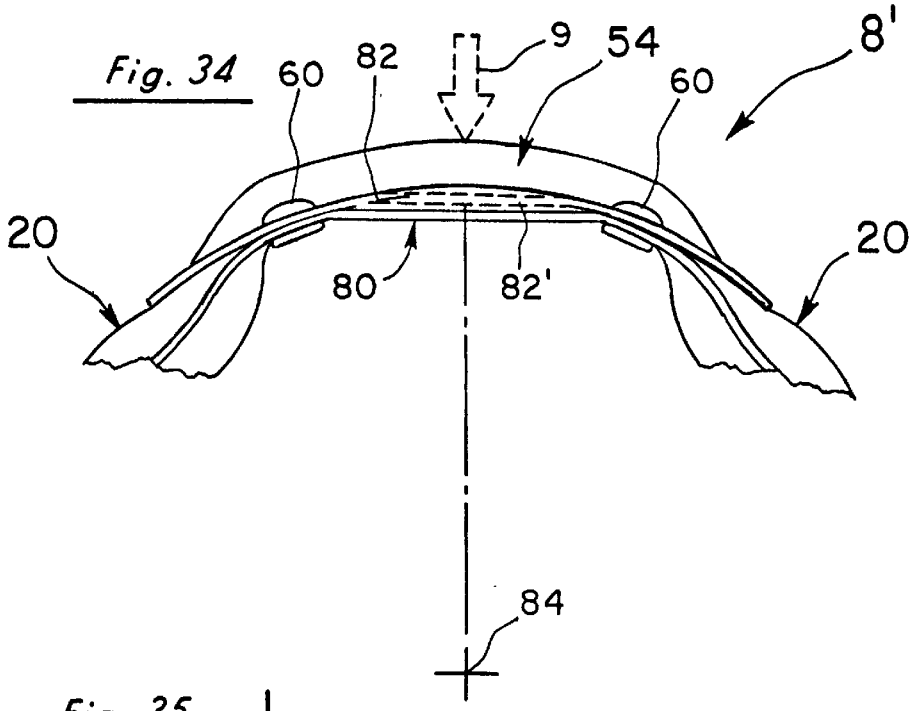
FIG. 34 is a view similar to FIG. 24 showing a reinforcing characteristic of the pontoon shape of the thigh padding.

FIG. 34 illustrates another aspect of the pontoon shape of the casings 20 of FIG. 24–25 in which the central portion 80 of the pontoon shape helps to reinforce the hard, outer shell 54. More specifically, the central portion 80 (i.e., the central portions or sides 30 and 32 of the flexible, inelastic material of casings 20 of FIG. 25) is attached at 60 to extend across the curved or arched, inner surface 82 of the hard shell 54 (see FIG. 24). The distance along the arched, concave, inner surface 82 about the axis 84 in FIG. 34 between the sections of the shell 54 at rivets 60 is then greater than the chord distance between the spaced-apart portions of 80 attached to the shell 54 at rivets 60. The chord-like portion 80 is preferably prestressed or pretensioned but can be simply taut if desired. Since the material of 80 is preferably inelastic and does not stretch, any force 9 applied in FIG. 34 tending to flatten the arch of surface 82 (e.g., toward the position 82' shown in dotted lines in FIG. 34) will be resisted by the piece of material 80. If desired, the portion 80 could be slightly loose if desired to then assume a taut or tightened condition upon any flattening movement of the arch at 82. Although preferably inelastic, the material of 80 could be elastic if desired and still act to reinforce the arched shape 82 of the shell 54.

Figure 35:
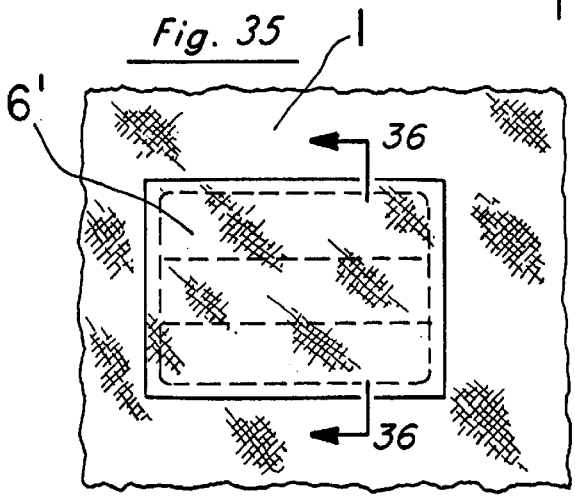
FIGS. 35–37 illustrate the application of features of the present invention to chest or sternum padding.
Figure 36:
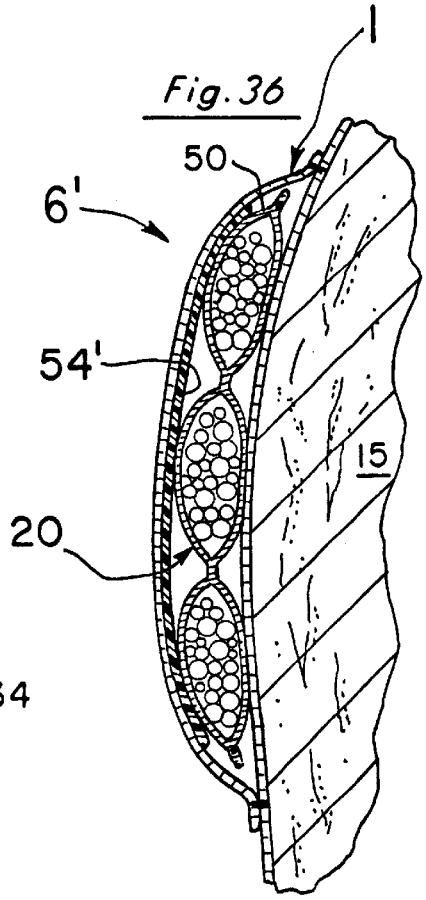
Figure 37:
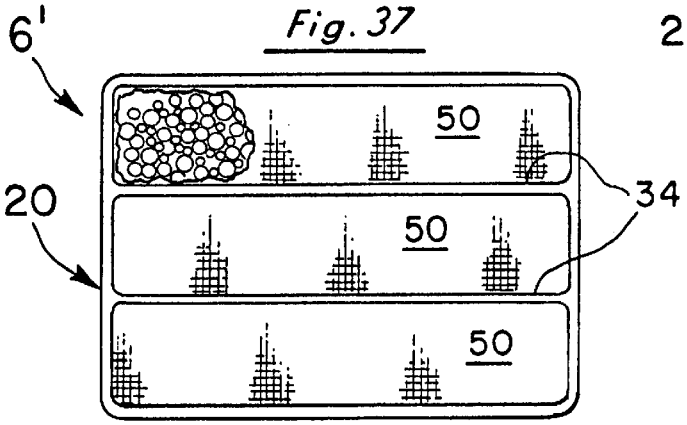

FIGS. 35–37 illustrate a modified chest or sternum padding 6'. In it, the padding 6' has a hard, outer shell 54' that is substantially flat or at least flatter than the shell 54 of FIG. 24. Additionally, casing 20 of FIGS. 35–37 is segmented at 34 (see FIGS. 36 and 37) to create multiple pouches 50. Each pouch 50 is preferably attached to the shell 54' as, for example, using rivets, hook and loop fasteners, or snaps. All of the pouches 50 are preferably underfilled as in FIG. 36 but could be gravity filled, overfilled, or a mix of the various degrees of filling. For example as shown in FIG. 37, the top pouch 50 could be underfilled, the middle pouch 50 gravity filled, and the bottom pouch 50 overfilled.

FIGS. 38–40 illustrate further modified padding 6" in which a pontoon-shaped, inner layer 86 (see FIG. 39) of beaded casings 20' with an interconnecting piece of material 88 is used with an overlying layer 90 of interconnected casings 20. The spaced-apart, pontoon casings 20' of layer 86 can be overfilled, gravity filled, or underfilled with beads. The layers 86 and 90 as shown are preferably attached at 60 (e.g., by stitching or rivets) to the hard, outer shell 54' with the respective casings 20' and 20 of the layers 86 and 90 staggered or nested relative to each other. In this manner, the layers 86 and 90 assume a relatively low profile. More importantly, the staggering positions the central pouch or casing 20 of layer 90 against the piece of material 88 extending between the pair of pontoon casings 20' of layer 86. The central casing 20 of layer 90 positioned against the connecting material 88 then essentially forms a triangle with the pair of pontoon casings 20' (see FIG. 38). Consequently, in use when a force 9 is applied as in FIG. 38, the force 9 will press the central casing 20 of the outer layer 90 against the piece of material 88 connecting the pontoon casings 20'. This in turn will transfer and spread out (dissipate) the force to the pontoon casings 20' somewhat in the manner of FIG. 29. As best seen in FIG. 40, the result of the layering and pontoon structure is that essentially all of the beaded casings 20' and 20 of both layers 86 and 90 are flattened and compressed against the athlete's body 15. To improve the flattening and increase the contact, surface area against the athlete's body 15, the pontoon casings 20' are preferably smaller than the casings 20 of the outer layer 90. The force or impact 9 is then not only greatly dissipated but also the transfer time through the pad 6" is significantly increased (e.g., by 1–2 milliseconds). The material 88 is preferably elastic to better accommodate the movement and flattening of the casings 20' and 20 of both layers 86 and 90 against the athlete's body 15. As shown, the upper and lower casings 20 of the outer layer 90 of FIG. 38 are also suspended in a similar manner by the pieces 88' of elastic material extending respectively between each of the attachments 60 and one of the pontoon casings 20'. In a similar but less effective way, forces applied to these upper and lower casings 20 of layer 90 are also transferred and dissipated through the immediately adjacent pontoon casing 20'.

Figure 41:
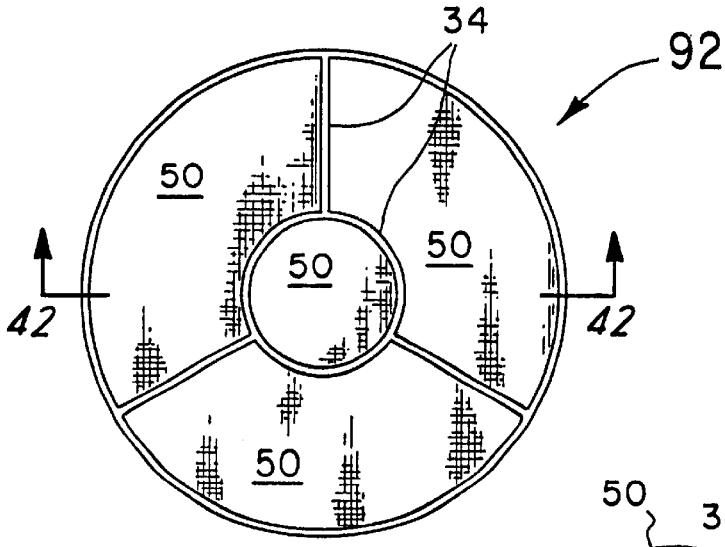
FIGS. 41–42 show the present invention adapted for use in a doughnut shaped pad.
Figure 42:
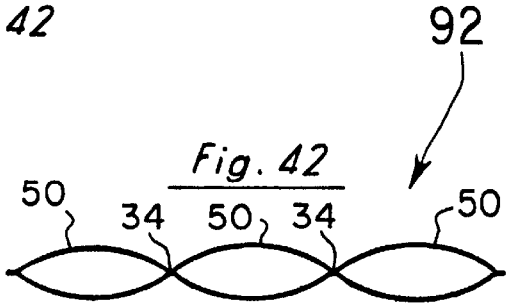

FIGS. 41 and 42 show a doughnut-shaped pad 92. The pad 92 is segmented at 34 wherein the filling degree of the various, beaded pouches 50 could be varied as desired in a manner similar to the padding 6' of FIG. 37. In one application of the pad 92 of FIG. 41 to protect, for example, the top of a shoulder and clavicle, the central pouch 50 might be underfilled or at least filled to a lesser degree than the surrounding pouches 50 (which could be overfilled, gravity filled, or underfilled). The pad 92 of FIGS. 41–42 as well as the one of FIGS. 43–44 discussed below could be used with or without a hard, covering shell 54.

Figure 43:
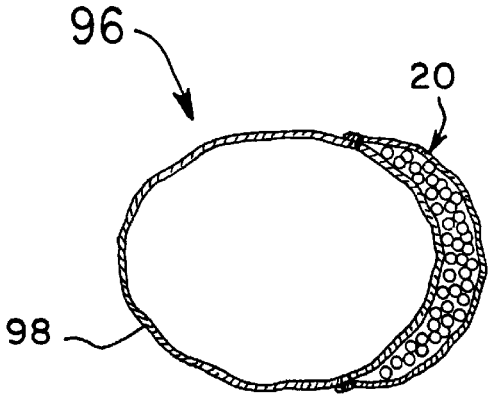
FIGS. 43–44 illustrate a method in which an overfilled casing can be created from an initially unfilled or gravity filled one.
Figure 44:
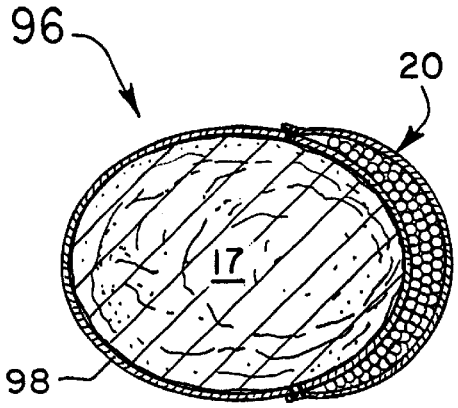

The pad 96 of FIG. 43 has an initially gravity filled or underfilled casing 20 attached to a stretchable band 98 such as would be applicable for use as an elbow, knee, or arm pad. In use, the stretchable, elastic band 98 will actually distort and constrict or reduce the volume of the casing 20 (compare FIGS. 43 and 44). The initially gravity filled or underfilled casing 20 of FIG. 43 will then assume the overfilled condition of the first set of protective padding of FIGS. 1–23 and act in the same manner. FIGS. 43 and 44 thus illustrate a method for creating an overfilled pad from an initially underfilled or gravity filled one. In doing so, the initially underfilled or gravity filled casing 20 is pressed against (stretched about) the user's body (i.e., arm 17 in FIG. 44) until the volume of the casing 20 is distorted or reduced to create an overfilled condition. The inelastic casing 20 is then under tension and substantially all of the beads are in compression. If the casing material is elastic, then the distortion preferably stretches the casing material to its elastic limit. Either way, the mere placing of the pad 96 on the athlete's arm 17 overfills the casing 20 and places it in condition to receive a blow in the manner of FIGS. 9–11. The pad 96 is preferably not used in combination with a hard, outer shell 54 but could be if desired.

Figure 45:
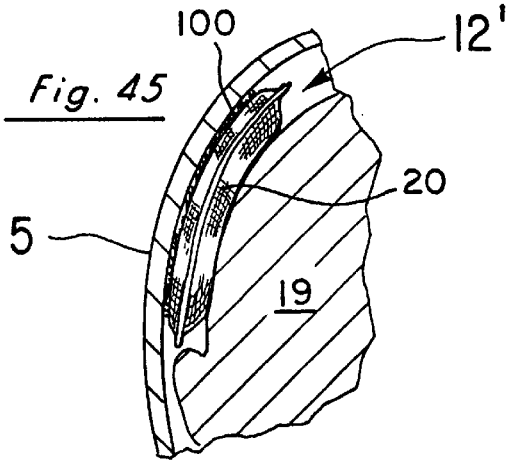
FIGS. 45–46 show a modified pad in which the beads are fused together into a desired shape.
Figure 46:
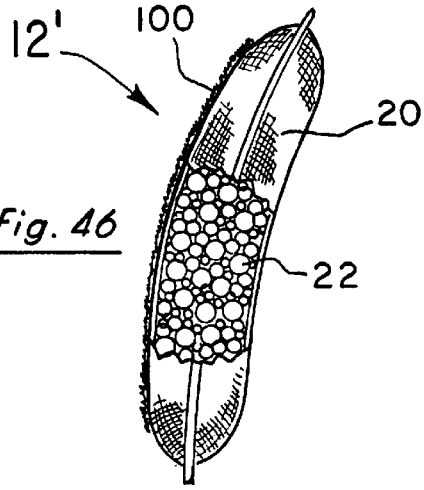

In the embodiment of FIGS. 45–46, the beads 22 (whether a blend of beads 66, 68, and 70 or not) are fused together wherein the pad itself assumes a predetermined shape. The beads are preferably a mix so that the characteristics of the overall pad, including softness and transfer time (attenuation) of the force through it, can be varied as desired. The fusing can be done, for example, by lightly steaming or gluing the beads. The shaping could be done by simply fusing the beads within a mold to create the desired shape or the desired shape could be achieved by first fusing the beads into boards or other bulk forms that were then cut to the desired shape. The fused beads could be used with or without an outer casing 20. When an outer casing 20 is used, it would preferably be attached about the beads either prior to or during the fusing process but could be done afterward. The fit of the casing 20 about the beads could be loose or snug but preferably would place the casing 20 in tension as, for example, by a shrink-wrapping process (e.g., heat up the polypropylene casing 20). This would also place the beads in a slight compression. The resulting pad 12' could then be used, for example, in the helmet 5 of FIG. 1 and removably attached in place to the hard shell of the helmet 5 using hook and loop fasteners (e.g., Velcro) 100 or snaps or more permanently attached with rivets if desired. The pad 12' could be nominally fashioned in progressive sizes to fit the contours of the athlete's head 19 or custom fused and shaped to the particular athlete exact shape. The casing 20 in this regard helps the pad 12' to maintain its integrity, particularly if the casing 20 is shrink-wrapped in place or otherwise attached to the beads (e.g., by glue). Further, should the pad 12' become fractured, the casing 20 helps to hold the pieces together. The casing 20 is preferably a very porous and breathable mesh and the beads are preferably made of lightweight, closed-cell foam. Even though adjacent, abutting portions of the fused beads are joined to each other, there still is a significant amount of interstitial spaces between the beads, which interstitial spaces and resulting high porosity and breathability preferably are substantially uniformly distributed throughout the entire pad 12'. The result is then a waterproof yet highly porous and breathable pad 12' that can be pre-shaped as desired. Like all the other, preferred pads and padding of the present invention, the pad 12' itself, does not absorb water or odors, is relatively cool to wear, and can be easily washed. In another embodiment, the waterproof beads 22 of the pad 12' of FIGS. 45–46 are made of substantially inelastic or crushable material (e.g., closed-cell polystyrene foam) and are preferably first subjected to a corona treatment in an inert gas atmosphere (e.g., a noble gas such as argon) to raise the surface energy of the beads 22 and then fused together (e.g., with an adhesive such as a water-based urethane or neoprene).

Figure 47:
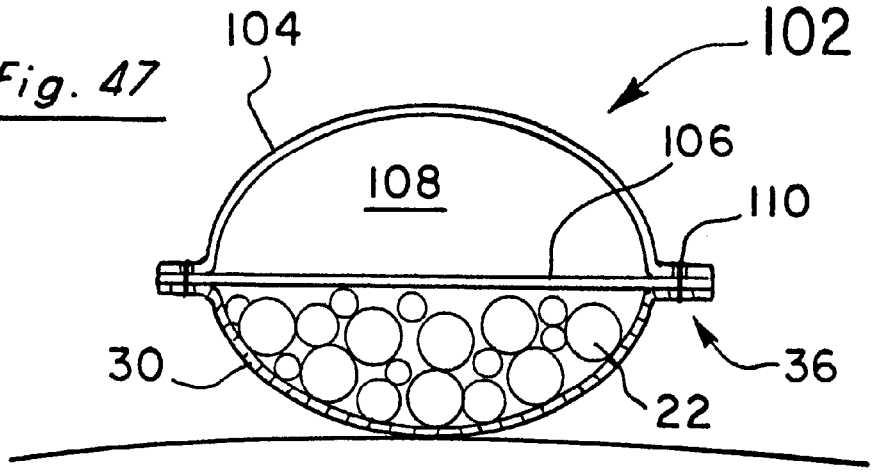
FIGS. 47–48 illustrate a modified pad in which the upper half is a waterproof and airtight compartment filled with open-cell foam and the lower half is a porous compartment filled with closed-cell, foam beads.
Figure 48:
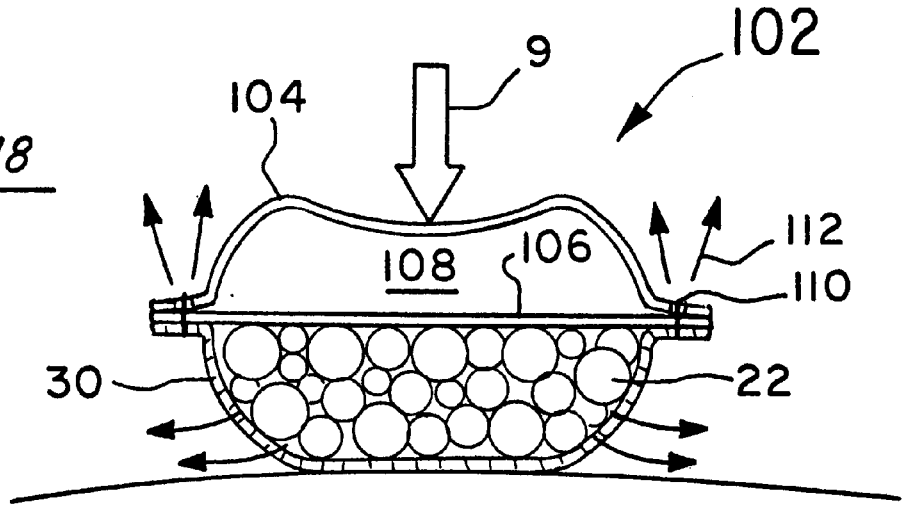

In the embodiment of FIGS. 47–48, a modified casing 102 is used which has a substantially waterproof and airtight upper portion 104 and a flexible, porous, breathable, lower portion 30 as in prior embodiments. Separating the two portions is an intermediate portion or layer 106 of the same material as portion 104. The upper half or compartment formed by portions 104 and 106 of the casing 102 is filled with a layer of open-celled foam 108 (e.g., urethane) and the lower half or compartment bounded by portions 30 and 106 is filled as in the prior embodiments with closed-cell, foam beads 22 (e.g., polypropylene). The boundaries at 36 of the portions 104, 106, and 30 are preferably sewn together at 110. In use when a blow or force 9 is applied as in FIG. 48, the upper half of the casing 102 is depressed under the force of the blow 9 to compress the open-celled foam 108 as well as the beads 22 in the lower half of the casing 20. The air from the open-cell foam 108 in the upper half of the casing 102 is expelled at 112 primarily through the holes about the stitches 110. Depending upon the characteristics of the sewing (e.g., spacing or number of stitches 110 per inch, the size of the stitch holes relative to the size of the stitches 110 themselves, the degree the pad is heated to vary the size of the stitch holes, the porosity of the material of the stitches 110, and the degree to which portions 104 and 106 are pressed or sealed together between the stitches 110), the rate of the escaping air 112 can be varied as desired. This in turn will give the overall pad varying degrees of softness and transfer time. The material of portion 104 in this regard is preferably waterproof and airtight (e.g., treated nylon) but could be waterproof and slightly porous to air if desired. The degree of air porosity through the material of 104 could then be varied to further modify the rate of the escaping air without adversely affecting the waterproofness of the upper compartment. The foam 108 in the upper half within portion 104 is preferably slightly compressed in the initial condition of FIG. 48. The beads in the lower half within portion 30 in FIG. 48 can be a mix if desired and this lower half of the casing 102 can be initially overfilled, gravity filled, or underfilled depending upon the particular application. In the preferred embodiment, the upper and lower halves or compartments of the casing 102 initially are filled to have substantially semicircular cross sections as illustrated in FIG. 48. As with the other embodiments, the pad of FIGS. 47–48 could be used with a hard, outer shell if desired.

We claim:

1. A porous, breathable pad for use as protective padding by a person to absorb the force of an impact and to protect the user from injury while allowing liquids and air to freely pass through the pad, said pad having a plurality of discrete, substantially solid beads of substantially inelastic and waterproof, closed-cell foam wherein some outer portions of adjacent beads abut one another and other outer portions of said adjacent beads are spaced from each other to create interstitial spaces, at least some of said adjacent beads being fused together at the abutting, outer portions thereof.

2. The pad of claim 1 wherein substantially all of said adjacent beads are fused together at the abutting, outer portions thereof.

3. The pad of claim 1 wherein said fused beads form a predetermined shape.

4. The pad of claim 1 wherein said interstitial spaces are substantially uniformly distributed throughout the pad.

* * * * *